US006370801B1

(12) United States Patent
Weyer et al.

(10) Patent No.: US 6,370,801 B1
(45) Date of Patent: Apr. 16, 2002

(54) HYDRAULIC COLLECTION TOOL

(75) Inventors: Dean R. Weyer, Enumclaw; Michael Kevin Kehler, Buckley, both of WA (US)

(73) Assignee: 1994 Weyer Family Limited Partnership, Enumclaw, WA (US)

( * ) Notice: Subject to any disclaimer, the term of this patent is extended or adjusted under 35 U.S.C. 154(b) by 0 days.

(21) Appl. No.: 09/448,311

(22) Filed: Nov. 23, 1999

(51) Int. Cl.[7] ..... E02F 3/96

(52) U.S. Cl. ..... 37/406; 37/409; 414/732; 414/739

(58) Field of Search ..... 37/403, 406, 407, 37/408, 409, 410, 468; 414/912, 724, 726, 738, 739, 732; 92/31, 32, 33, 107, 108

(56) References Cited

U.S. PATENT DOCUMENTS

| | | | | | |
|---|---|---|---|---|---|
| 3,767,070 | A | | 10/1973 | Arnold | 214/146 R |
| 3,854,608 | A | | 12/1974 | Arnold | 214/145 |
| 4,313,367 | A | * | 2/1982 | Weyer | 92/33 |
| 4,409,888 | A | * | 10/1983 | Weyer | 92/31 |
| 4,508,016 | A | * | 4/1985 | Weyer | 92/33 |
| 4,845,867 | A | * | 7/1989 | Albrecht | 37/117.5 |
| 4,906,161 | A | * | 3/1990 | Weyer | 414/705 |
| 4,907,356 | A | * | 3/1990 | Labounty | 37/117.5 |
| 5,054,372 | A | * | 10/1991 | Weyer | 92/13.5 |
| 5,145,313 | A | * | 9/1992 | Weyer | 414/723 |
| 5,242,258 | A | * | 9/1993 | Weyer | 414/723 |
| 5,447,095 | A | * | 9/1995 | Weyer | 92/33 |
| 5,487,230 | A | * | 1/1996 | Weyer | 37/468 |
| 5,607,251 | A | * | 3/1997 | Rafn | 403/348 |
| 5,671,652 | A | * | 9/1997 | Weyer | 92/33 |
| 5,743,030 | A | * | 4/1998 | Sirr | 37/406 |

OTHER PUBLICATIONS

Wain–Roy, Inc. Brochure.

* cited by examiner

*Primary Examiner*—Victor Batson
(74) *Attorney, Agent, or Firm*—Seed IP Law Group PLLC

(57) ABSTRACT

A tool assembly using a fluid-powered actuator and including first and second tool members. The first tool member is pivotably connectable to a boom arm of a vehicle or stationary support platform for rotation about a first axis. The first tool member is also attached to a body of the actuator and the second tool members is attached to a shaft of the actuator so that operation of the actuator rotates the second tool member relative to the first tool member about a second axis spaced apart from the first axis and independent of rotation of the first tool member about the first axis. The second tool member is positioned to cooperatively engage the first tool member to assist in collection operations. The actuator has a generally cylindrical body with an output shaft rotatably disposed therein for rotation about the second axis. A linear-to-rotary transmission device disposed within the actuator body produces selective rotational movement of the shaft relative to the body and hence the second tool member relative to the first tool member. As the actuator goes through a range of motion the tool assembly moves between fully open and fully closed positions. In one embodiment, the actuator body is disposed in and attached to a protective support tube having the first tool member attached thereto. Other embodiments have further rotation and tilting assemblies to provide three orthogonal axes of rotation. Another attaches the tool members so that the first and second axes are coaxial.

57 Claims, 17 Drawing Sheets

HYDRAULIC COLLECTION TOOL

TECHNICAL FIELD

The present invention relates generally to equipment using one tool member to collect and a second tool member cooperatively positioned to assist in collecting, and more particularly, to hydraulic powered tools mountable on a boom of a vehicle or stationary platform.

BACKGROUND OF THE INVENTION

Assemblies such as large grapples or buckets with a bucket extension or a lid have been employed in the past for collection and sorting of large and small objects or quantities of material. Many of these collection assemblies have two members such as a bucket and a bucket extension which are selectively operable to work together. The collection assembly is generally attached to a boom arm of a platform such as a vehicle. The two members of the collector assembly are positioned to cooperatively engage each other to assist in the collection operation. One member assists the other member by providing a complimentary function such as in the case of the bucket lid or extension providing the bucket with enlarged capacity extension in one position, or grasping therebetween materials scooped up by the bucket. In the case of a grapple, the two members grasp items therebetween.

Generally, means are provided to separately supply rotational torque to one or both members in order to move one member relative to the other member. The operational limitation of a particular collection assembly is directly dependent upon the maximum amount of torque that can be supplied to the members. If the torque is not sufficient, the object size or the quantity of the material collected is limited.

It will therefore be appreciated that there has long been a significant need for an improved collection assembly. It should include a torque-transmitting member which is able to reliably supply sufficient torque to perform rough work such as tearing down a building and more delicate work such as sorting bricks from wood for recycling. The present invention fulfills these needs and further provides other related advantages.

SUMMARY OF THE INVENTION

The present invention resides in a fluid-powered tool assembly usable with a stationary or movable support platform having an arm. The tool assembly includes an arm connection member pivotably connectable to the arm for rotation about a first axis. It also includes a first tool member, and a second tool member positioned to cooperate with the first tool member. The assembly includes a body having a longitudinal axis and one of the first and second members attached thereto for movement with the body. A shaft is rotatably disposed within the body in general alignment with the body axis for rotation about a second axis spaced apart from the first axis. The shaft has the other of the first and second tool members attached thereto for movement with the shaft. A linear-to-rotary torque transmission member is mounted for longitudinal movement within the body in response to selective application of pressurized fluid thereto. The torque-transmitting member engages the body and the shaft to translate longitudinal movement of the torque-transmitting member into rotational movement of the shaft relative to the body. The first and second tool members are rotatable relative to each other about the second axis by operation of the torque-transmitting member. The pivotal connection of the arm connection member to the arm allows rotation of the tool assembly as a unit about the first axis.

In some embodiments, the tool assembly includes a support housing sized to receive and support the body therein. In one embodiment the body has first and second end portions, and the first body end portion is attached to the support housing and the second body end portion is engaged by the support housing to restrict transverse movement of the second body end portion. The one of the first or second tool members attached to the body is indirectly attached to the body through the support housing in one embodiment.

In another embodiment, the tool assembly includes a lateral tilt assembly having an actuator operable to laterally tilt the first and second tool members relative to the arm. The arm connection member is attached to the lateral assembly. This embodiment may also include a rotation assembly to selectively rotate the tool assembly about a transverse axis. A disclosed embodiment uses a turntable bearing.

In certain embodiments, the shaft has first and second opposite shaft end portions with the other of the first and second tool members attached to both the first and second shaft end portions for movement with the shaft.

One embodiment of the invention further includes a vehicle frame to which the arm of the support platform is attached. The tool assembly is preferably attached to the arm.

Other features and advantages of the invention will become apparent from the following detailed description, taken in conjunction with the accompanying drawings.

DETAILED DESCRIPTION OF THE INVENTION

Figure 1:
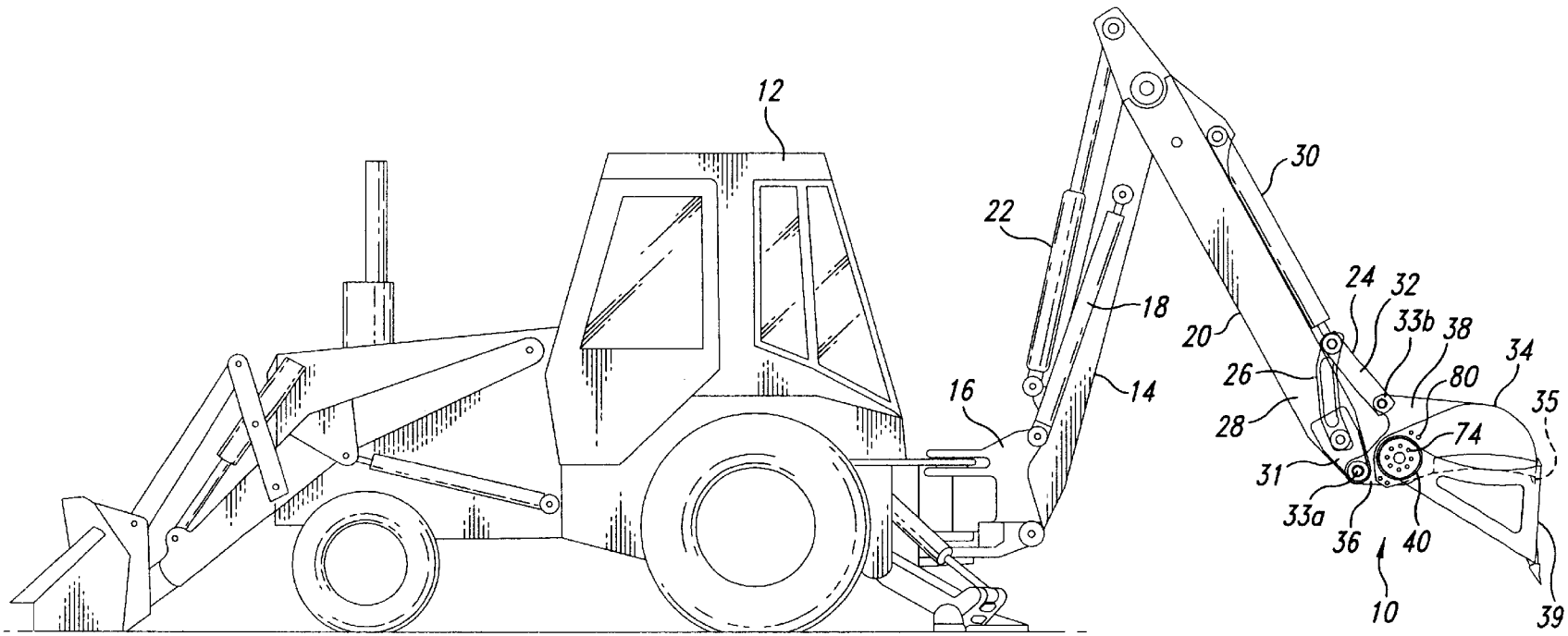
FIG. 1 is a left side elevational view of a backhoe vehicle shown with a tool assembly embodying the present invention having a bucket and a bucket extension for a collection operation.

As shown in the drawings for purposes of illustration, the present invention is embodied in a fluid-powered tool assembly, indicated generally by reference numeral 10. As shown in FIG. 1, the tool assembly 10 is usable with a support platform shown as a vehicle 12. The support platform may also be a stationary platform. The vehicle 12 has a first boom arm 14 which is pivotally connected by one end to a base member 16. A pair of hydraulic cylinders 18 (only one being shown in FIG. 1) is provided for raising and lowering the first arm 14 in a generally vertical arm rotation plane with respect to the base member 16. A second boom arm 20 is pivotally connected by one end to an end of the first arm 14 remote from base member 16. A hydraulic cylinder 22 is provided for rotation of the second arm 20 relative to the first arm 14 in the same vertical arm rotation plane as the first arm operates.

The base member 16 is pivotally attached to the vehicle 12 for pivotal movement about a vertical axis so as to permit movement of the first and second arms 14 and 20 in unison to the left or right, with the first and second arms always being maintained in the arm rotation plane. It is noted that while the arm rotation plane is forwardly extending as shown in FIG. 1, as the base member 16 is pivoted the arm rotation plane turns about the vertical pivot axis of the base member and thus loses its forward-to rearward orientation, with the plane actually extending laterally should the base member be sufficiently rotated. When the tool assembly 10 is used by an excavator with a cab unit mounted by a turntable bearing to a tracked carriage, the cab and hence the arm rotation plane of the first and second arms 14 and 20 can rotate 360° relative to the carriage.

A rotation link 24 is pivotally connected through an interconnecting link 26 to an end portion 28 of the second arm 20 remote from the point of attachment of the second arm to the first arm 14. A hydraulic cylinder 30 is provided for selective movement of the rotation link 24 relative to the second arm 20.

As is conventional, a free end portion 31 of the second arm 20 and a free end portion 32 of the rotation link 24 each has a transverse aperture therethrough for connection of the second arm and the rotation link to a tool using selectively removable attachment pins 33*a* and 33*b*, respectively. The attachment pins 33*a* and 33*b* are insertable in the apertures to pivotally connect a conventional tool to the second arm and the rotation link. When using a conventional tool, this permits the tool to be rotated about the attachment pin 33 of the second arm 20 upon movement of the rotation link 24 relative to the second arm as a result of extension or retraction of the hydraulic cylinder 30 to rotate the tool in the arm rotation plane defined by the first and second arms 14 and 20. A quick coupler or other mounting means may be used to connect the tool to the second arm 20 and the rotation link 24. In an alternative embodiment not shown, the links 24 and 26 are not used and the hydraulic cylinder 30 is directly attached to the tool to be rotated.

As illustrated in FIG. 1, the tool assembly 10 comprises a first tool which in the case of the illustrated embodiment is a bucket 34. The bucket 34 has a forward working edge 35 extending laterally, generally transverse to the arm rotation plane. The bucket 34 further includes a first clevis 36 and a second clevis 38. The first clevis 36 is located toward the bucket working edge 35 and is attached to the free end portion 31 of the second arm 20 with the attachment pin 33*a*. The second clevis 38 is located rearwardly away from the first clevis 36 and is attached to the free end portion 32 of the rotation link 24 with the attachment pin 33*b*. The first and second clevises 36 and 38 are in general parallel alignment with the arm rotation plane of the bucket 34. It should be understood the present invention may be practiced using other tools as work implements, and is not limited to buckets or other collection tools and devices.

The tool assembly 10 also includes a second tool which in the case of the embodiment illustrated in FIG. 1 is a lid or bucket extension 39. As part of the tool assembly 10, both the bucket 34 and the bucket extension 39 are connected to a rotary actuator 40 for pivotal movement relative to each other. This allows for the bucket extension 39 to rotate relative to the bucket 34 about an axis of rotation 41 of the rotary actuator 40 (see FIG. 3). The rotary actuator 40 provides rotational torque which causes the bucket extension 39 to rotate about the axis 41 of the rotary actuator 40 relative to the bucket 34.

Figure 2B:
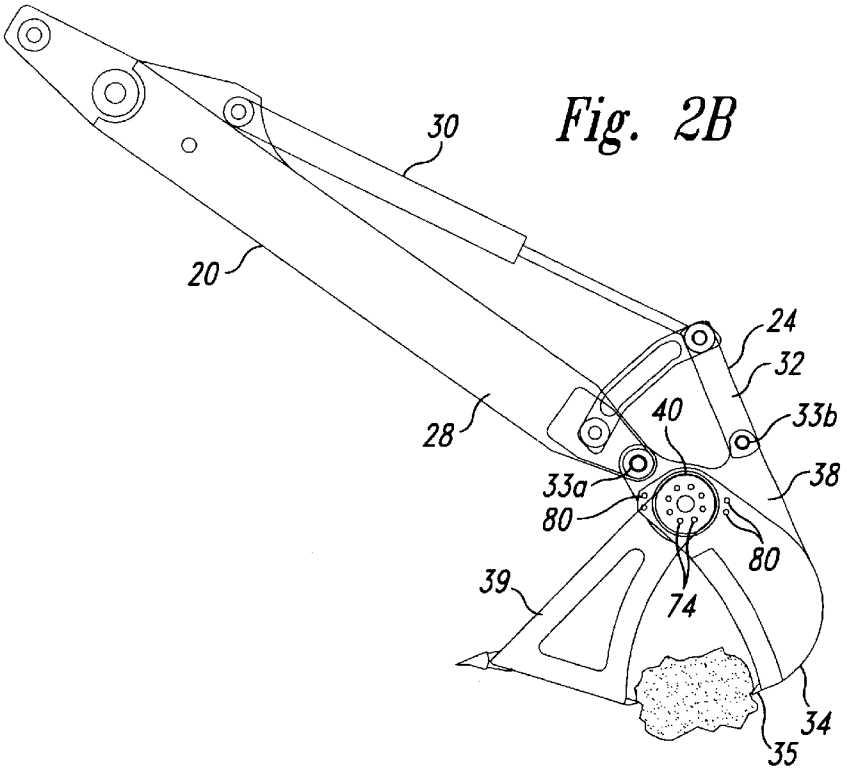
FIGS. 2*a*–2*d* are enlarged, left side elevational views of the boom arm and the tool assembly of FIG. 1 removed from the vehicle, with the bucket shown in various rotational positions relative to the boom arm and the bucket extension shown in various rotational positions relative to the bucket.
Figure 2A:
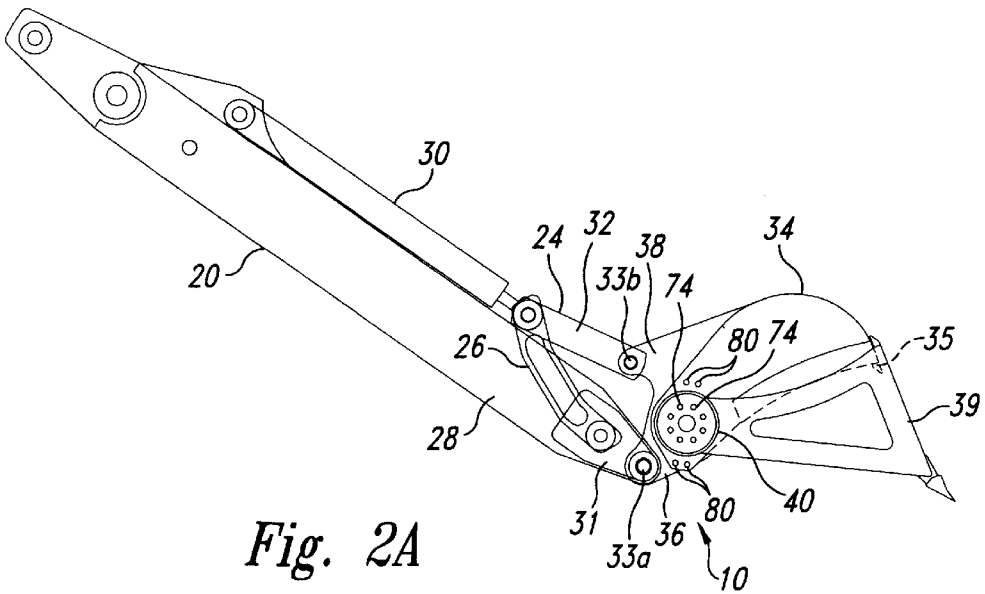
Figure 2D:
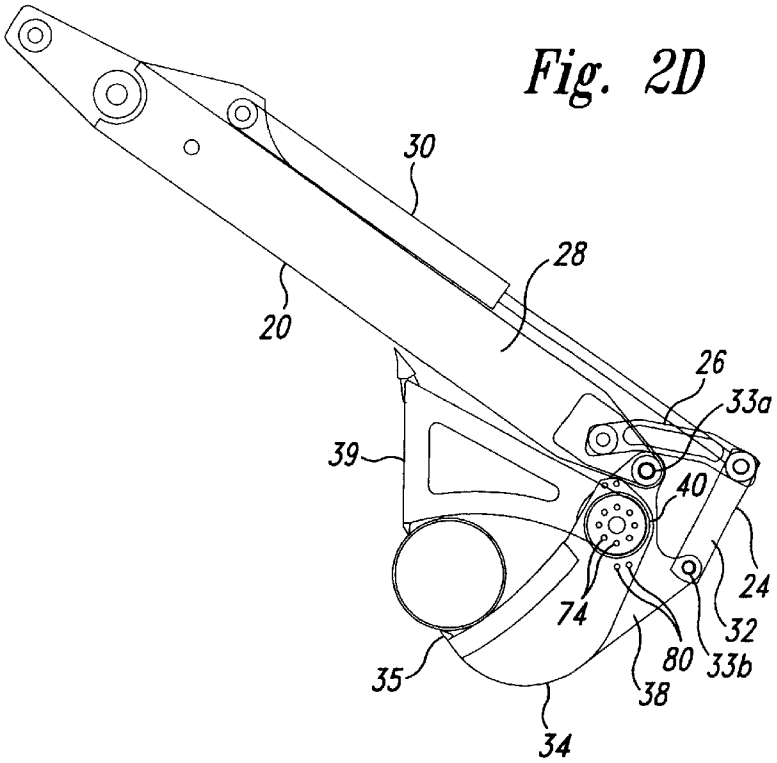
Figure 2C:
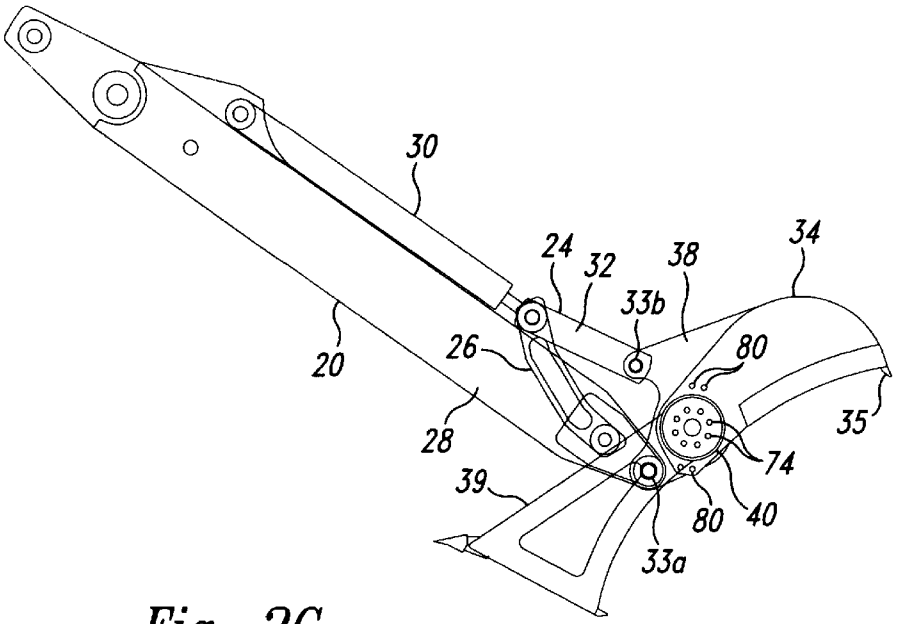

FIGS. 2*a*–2*d* illustrate four positions of the bucket 34 relative to the second arm 20. In operation, the movement of the rotation link 24 relative to the second arm 20 causes the bucket 34 to be selectively rotated through the arm rotation plane about the attachment pin 33*a* of the second arm 20 as the rotation link is moved relative to the second arm 20 by the hydraulic cylinder 30. FIGS. 2*a* and 2*c* show the bucket 34 rotated in a fully counterclockwise position relative to the second arm 20 with the hydraulic cylinder 30 in a fully retracted state. FIG. 2*b* shows the bucket 34 in a midway position relative to the second arm 20 with the hydraulic cylinder in a semi-extended state. FIG. 2*d* shows the bucket 34 rotated in a fully clockwise position relative to the second arm 20 with the hydraulic cylinder 30 in a fully extended state.

FIGS. 2*a*–2*d* also illustrate possible positions of the bucket extension 39 relative to the bucket 34 resulting from operation of the rotary actuator 40 causing the bucket extension to rotate about the axis 41 of the rotary actuator. The position of the bucket extension 39 relative to the bucket 34 produced by operation of the rotary actuator 40 is independent of the position of the bucket 34 relative to the second arm 20 produced by operation of the hydraulic cylinder 30, although in certain positions of the bucket the presence of the second arm blocks full movement of the bucket extension through its full range of movement. FIG. 2*a* shows the bucket extension 39 in a fully counterclockwise closed position relative to the bucket 34. FIG. 2*c* shows the bucket extension 39 in a fully clockwise open position relative to the bucket 34. FIGS. 2*b* and 2*d* show the bucket extension 39 in a midway position relative to the bucket 34 with the bucket 34 and bucket extension grasping therebetween an object such as a large rock (FIG. 2*b*) or a culvert pipe (FIG. 2*d*). The bucket extension may also be selectively and delicately used to grasp chosen articles in cleanup or sorting processes.

Figure 3:
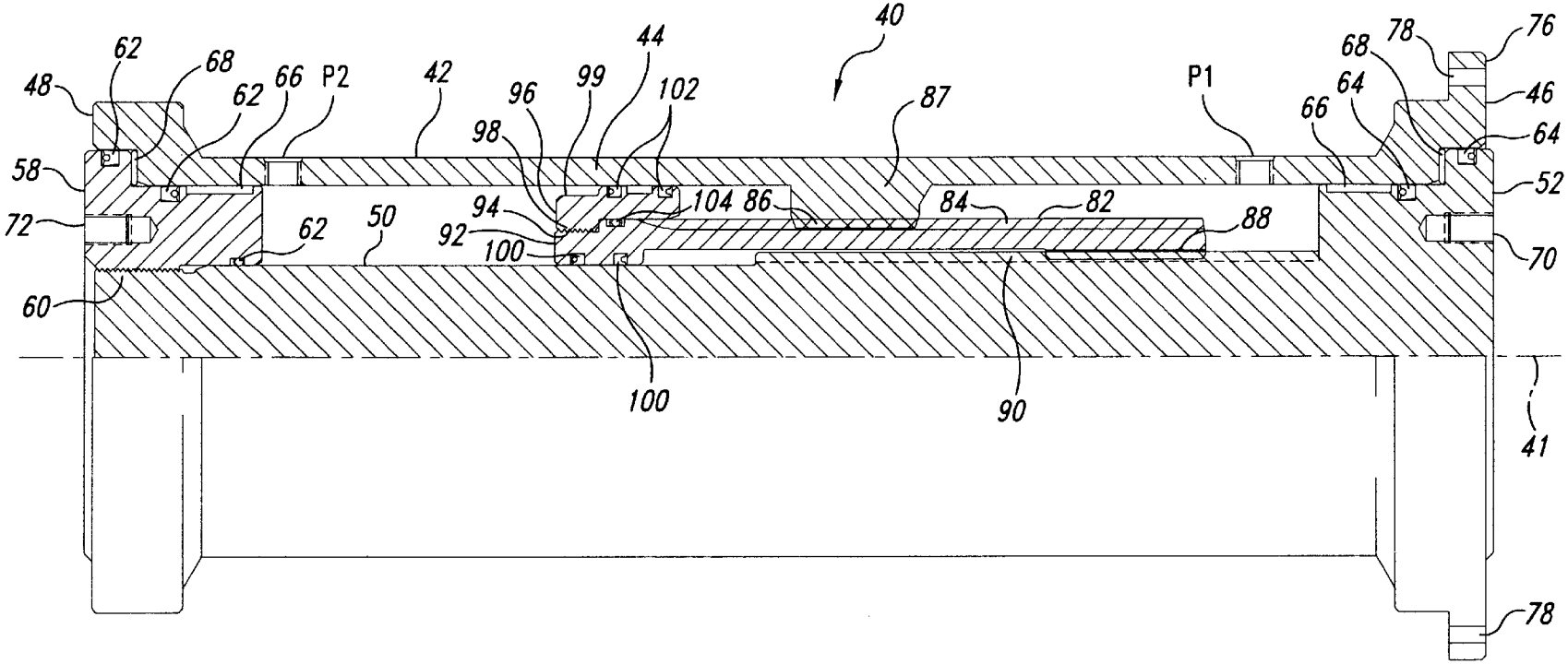
FIG. 3 is an enlarged, front elevational, sectional view of the fluid-powered rotary actuator of FIG. 1 used to rotate the bucket extension relative to the bucket shown without attachment members for the boom arm.

The construction of the rotary actuator 40 is best shown in FIG. 3. The rotary actuator 40 has an elongated housing or body 42 with a cylindrical sidewall 44 and first and second ends 46 and 48, respectively. An elongated rotary drive or output shaft 50 is coaxially positioned within the body 42 and supported for rotation relative to the body 42. The shaft 50 extends the full length of the body 42, and has a flange portion 52 at the first body end 46. The shaft 50 has an annular shaft nut 58 threadably attached thereto at the second body end 48. The shaft nut 58 has a threaded interior portion threadably attached to a correspondingly threaded perimeter portion 60 of the shaft 50 and the shaft nut rotates with the shaft. The shaft nut 58 is generally locked in place against rotation relative to the shaft 50.

Seals 62 are disposed between the shaft nut 58 and the shaft 50, and between the shaft nut and the body sidewall 44 to provide a fluid-tight seal therebetween. Seals 64 are disposed between the shaft flange portion 52 and the body sidewall 44 to provide a fluid-tight seal therebetween. Radial bearings 66 and thrust bearings 68 are disposed between the shaft flange portion 52 and the body sidewall 44, and between the shaft nut 58 and the body sidewall 44 to support the shaft 50 against radial and longitudinal thrust loads and to secure the shaft 50 in the body 42.

The exterior end surfaces of the shaft flange portion 52 and the shaft nut 58 are flat and each have a plurality of apertures 70 and 72, respectively, which threadably receive attachment bolts 74 (shown in FIGS. 2*a*–2*d*) to attach the bucket extension 39 to the shaft 50 for movement therewith relative to the body 42. The first body end 46 also has a flange portion 76 with apertures 78 which receive attachment bolts 80 (shown in FIGS. 2*a*–2*d*) for attaching the body 42 of the rotary actuator 40 to the bucket 34.

As shown in FIG. 3, an annular piston sleeve 82 is coaxially and reciprocally mounted within the body 42 coaxially about the shaft 50. The piston sleeve 82 has outer splines, grooves or threads 84 over a portion of its length which mesh with inner splines, grooves or threads 86 of a splined intermediate interior ring gear portion 87 of the body sidewall 44. The piston sleeve 82 is also provided with inner splines, grooves or threads 88 which mesh with outer splines, grooves or threads 90 provided on a portion of the shaft 50 toward the first body end 46. It should be understood that while helical splines are shown in the drawings and described herein, the principle of the invention is equally applicable to any form of linear-to-rotary motion conversion means, such as balls or rollers. At least one pair of meshing splines, grooves or threads are helical to convert axial motion of the piston sleeve 82 to rotary motion of the shaft 50. Alternatively, all the splines, grooves or threads can be helical and/or can be threaded in the same direction (e.g., left-handed or right-handed) or different directions, depending on the desired direction and amount of shaft rotation per unit of axial motion of the piston sleeve 82. It should be understood that while splines are shown in the drawings and described herein, the principle of the invention is equally applicable to any form of linear-to-rotary motion conversion arrangement, such as balls or rollers, and that the splines can include any type of groove or channel suitable for such motion conversion.

In the illustrated embodiment of the invention, the piston sleeve 82 has an annular piston head member 92 which has a threaded exterior portion 94 threadably attached to a second annular piston head member 96 by a correspondingly threaded interior portion 98 of the second annular piston head member 96. The two piston head members 92 and 96 are thus joined to form a common piston head 99. Seals 100 are disposed between the piston head member 92 and a smooth exterior wall shaft of the shaft 50 to provide a fluid-tight seal therebetween. Seals 102 are disposed between the piston head member 96 and the interior wall surface of the body-sidewall 44 to provide a fluid tight seal therebetween. A seal 104 is disposed between the piston head member 92 and piston head member 96 to provide a fluid tight seal therebetween.

As will be readily understood, reciprocation of the common piston head 99 within the body 42 occurs when hydraulic oil, air or any other suitable fluid under pressure selectively enters through one or the other of a first port P1 which is in fluid communication with a fluid-tight compartment within the body to a side of the piston head toward the first body end 46 or through a second port P2 which is in fluid communication with a fluid-tight compartment within the body to a side of the piston head toward the second body end 48. As the piston head 99 and the piston sleeve 82, of which the common piston head is a part, linearly reciprocates in an axial direction within the body 42, the outer splines, grooves or threads 84 of the piston sleeve engage or mesh with the inner splines, grooves or threads 86 of the body sidewall 44 to cause rotation of the piston sleeve, where both the outer splines 84 and the inner splines 86 are helical. The linear and rotational movement of the piston sleeve 82 is transmitted through the inner splines, grooves or threads 88 of the piston sleeve to the outer splines, grooves or threads 90 of the shaft 50 to cause the shaft to rotate. The smooth wall surface of the shaft 50 and the smooth wall surface of the body sidewall 44 have sufficient axial length to accommodate the full end-to-end reciprocating stroke travel of the piston sleeve 82 within the body 42. Longitudinal movement of the shaft 50 is restricted, thus most movement of the piston sleeve 82 is converted into rotational movement of the shaft 50. Depending on the slope and direction of turn of the various splines, grooves or threads, there may be provided a multiplication of the rotary output of the shaft 50 and a high level of torque may also be provided.

The application of fluid pressure to the first port P1 produces axial movement of the piston sleeve 82 toward the second body end 48. The application of fluid pressure to the second body port P2 produces axial movement of the piston sleeve 82 toward the body first end 46. The rotary actuator 40 provides relative rotational movement between the body 42 and shaft 50 through the conversion of linear movement of the piston sleeve 82 into rotational movement of the shaft, in a manner well known in the art. The shaft 50 is selectively rotated by the application of fluid pressure, and the rotation is transmitted to the bucket extension 39 or other tool attached thereto through the flange portion 52 of the shaft 50 to selectively rotate the bucket extension about the axis 41 of the rotary actuator 40 relative to the bucket 34. It is noted that operation of the rotary actuator 40 to move the bucket extension 39 relative to the bucket 34 is not only independent of the rotation of the bucket 34 relative to the second arm 20 by operation of the hydraulic cylinder 30, but is also about the axis 41 which is different and spaced apart from the axis of rotation of the bucket about the attachment pin 33*a*.

Figure 6:
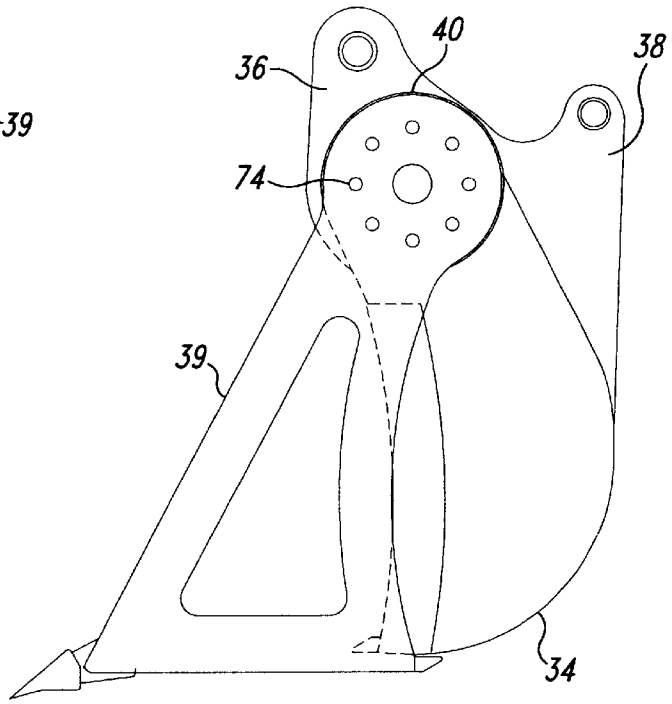
FIG. 6 is a left side elevational view of the tool assembly of FIG. 5.
Figure 5:
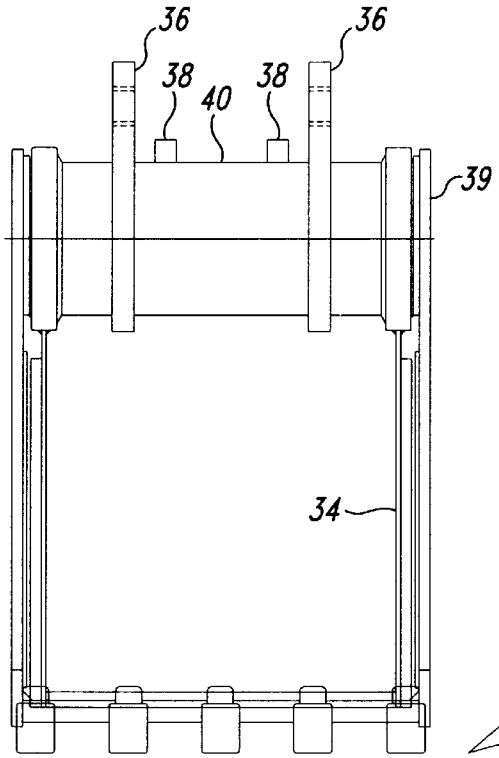
FIG. 5 is a front elevational view of the tool assembly of FIG. 4.
Figure 4:
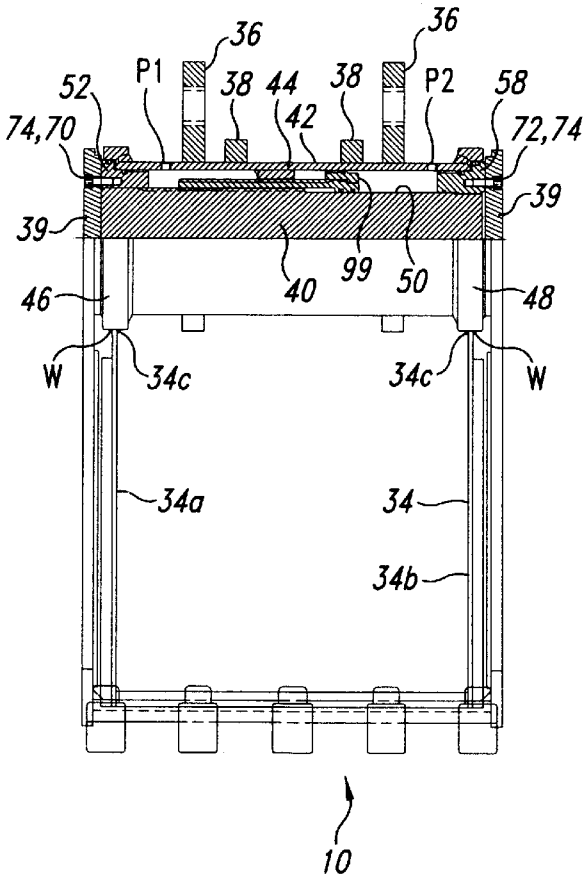
FIG. 4 is an enlarged, front elevational, sectional view of the tool assembly of FIG. 1 shown removed from the boom arm using an alternative manner of attaching the bucket to the actuator body.

FIGS. 4–6 show the tool assembly 10 having an alternative manner of attaching the bucket 34 to the body 42 of the rotary actuator 40. In particular, the opposing side walls 34*a* and 34*b* of the bucket 34 each have an aperture 34*c* therein which receives a corresponding one of the first and second body ends 46 and 48 of the body 42 therein. The first and second body ends 46 and 48 are welded to the corresponding side walls 34*a* and 34*b* of the bucket 34 by welds W. Thus, the attachment apertures 78 in the flange portion 76 of the first body end are not necessary.

Figure 8:
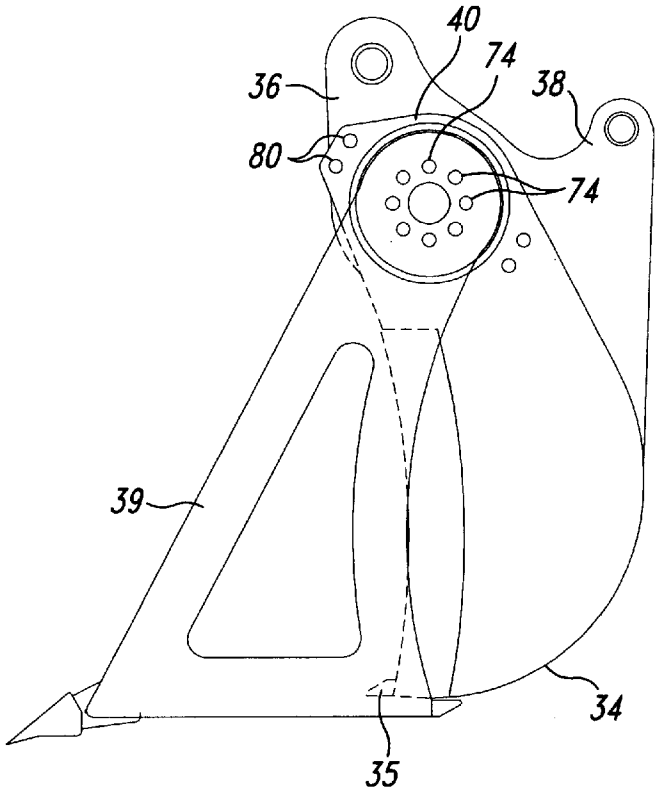
FIG. 8 is a left side elevational view of the tool assembly of FIG. 7.
Figure 7:
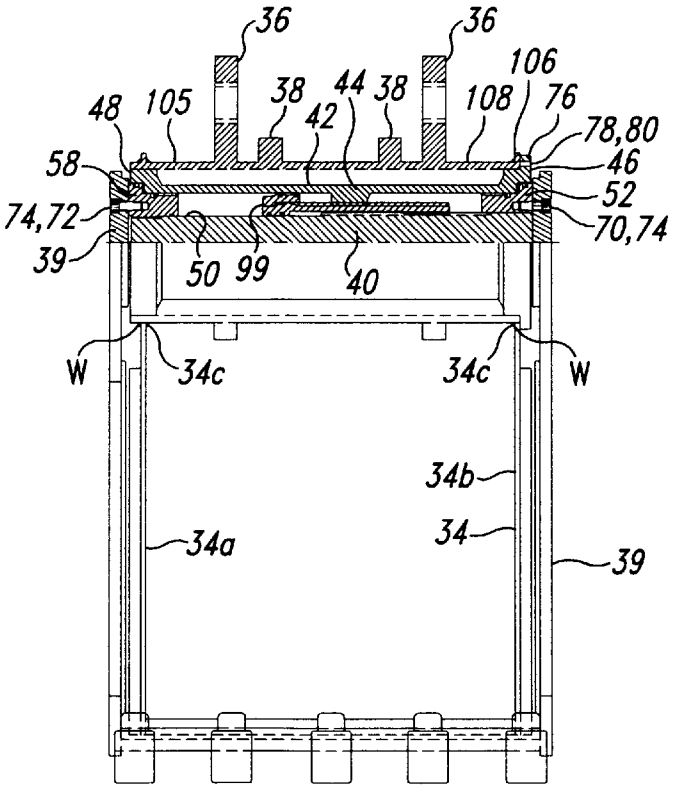
FIG. 7 is a front elevational, sectional view of a first alternative embodiment of the tool assembly of FIG. 1.

FIGS. 7 and 8 depict a first alternative embodiment of the tool assembly 10 in which the rotary actuator 40 is removably positioned within a support housing or tube 105. In this embodiment, the flange portion 76 of the first body end 46 uses the attachment bolts 80 to attach the actuator body 42 to a flange portion 106 of the support tube 105. The second body end 48 of the rotary actuator 40 is snugly received in the support tube 105 in engagement with a cylindrical wall 108 thereof, but is not attached thereto. This limits transverse movement of the second body end 48 during operation of the tool assembly 10. The support tube 105 also allows the actuator 40 to be slidably received coaxially within the support tube and protected from damage by the cylindrical wall 108 of the support tube. The support tube 105 further adds structural rigidity to the assembly 10. The rotary actuator 40 is slidably removable from the support tube 105 for servicing of the actuator. In this embodiment, the bucket side walls 34*a* and 34*b* are welded to the support tube 105 by welds W, rather than to the first and second body ends 46 and 48.

Figure 9:
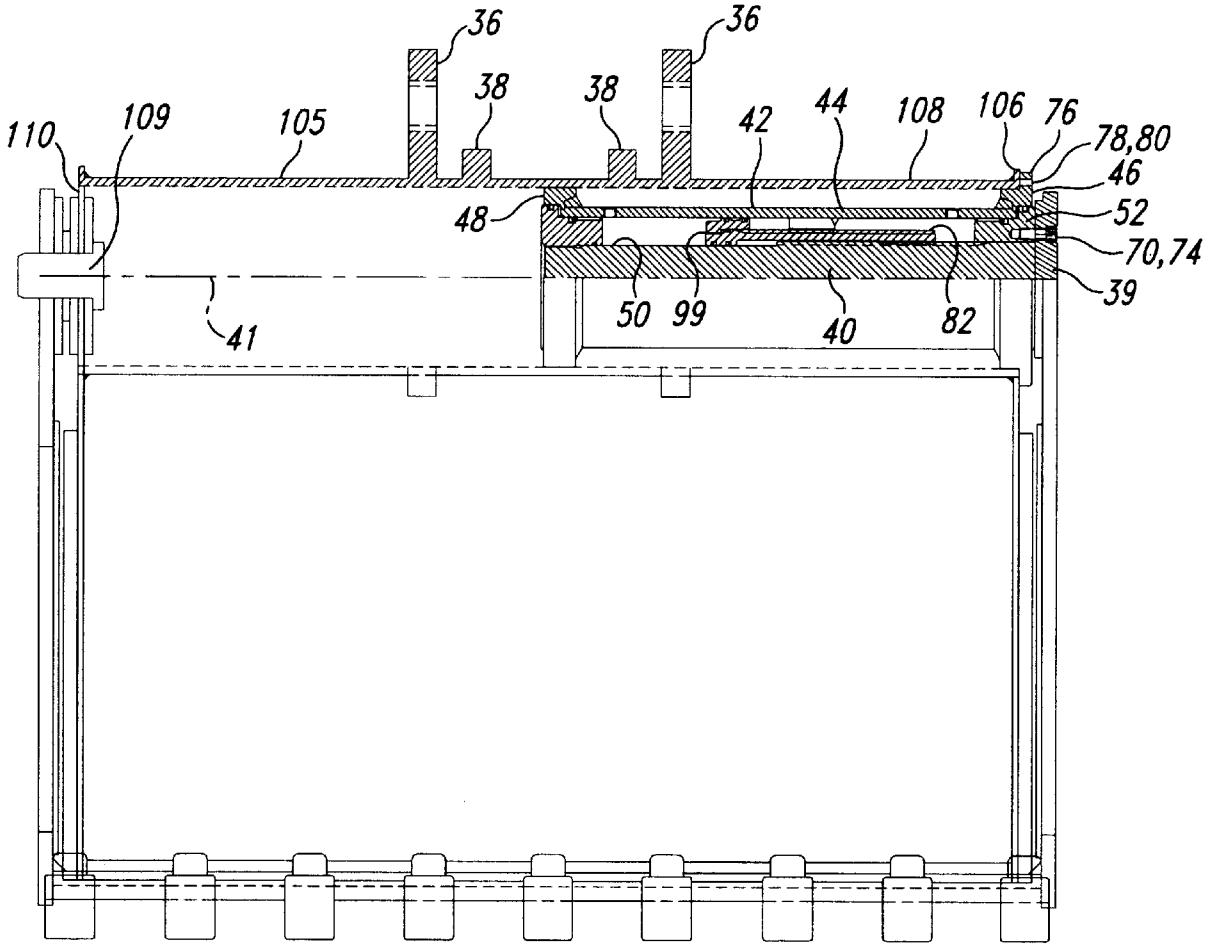
FIG. 9 is a front elevational, sectional view of a second alternative embodiment of the tool assembly of FIG. 1.

FIG. 9 depicts a second alternative embodiment of the tool assembly 10 in which the rotary actuator 40 does not extend the entire length of the support tube 105. Like the embodiment of FIGS. 7 and 8, in the embodiment of FIG. 9, the actuator body 42 is attached to the support tube 105 only at the first body end 46 of the actuator and is slidably received in the support tube with the second body end 48 snugly received by the cylindrical wall 108. In an alternative design, to improve alignment, rather than bolting the bucket extension 39 to the shaft 50, the shaft may be terminated with straight splines which project axially outward and drivingly engage corresponding straight splines of a recess in the bucket extension coaxially aligned with the shaft of the rotary actuator 40. Because the rotary actuator 40 used in FIG. 9 is shorter than the bucket 34 is wide, the bucket extension 39 is not attached directly to the shaft nut 58 as in the previously described embodiments. Instead, a pivot pin 109 is used to rotatably mount the bucket extension 39 to an end plate 110 closing the end of the tube support 105 at the end opposite the end to which the flange portion 76 of the first body end 46 is attached. The pivot pin 109 provides an axis of rotation aligned with the axis 41 of the rotary actuator 40.

Figure 10C:
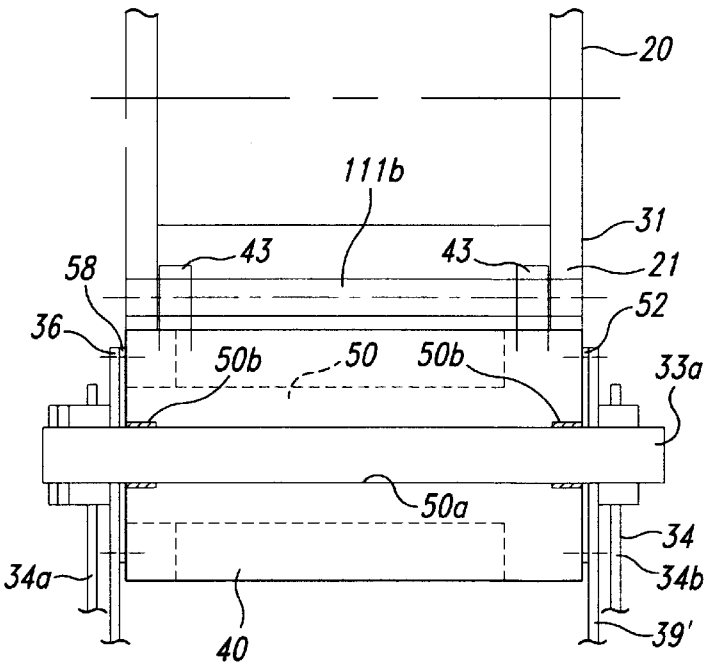
FIG. 10*c* is an enlarged, fragmentary, front view of the third alternative embodiment of the tool assembly shown in FIG. 10*b*.
Figure 10B:
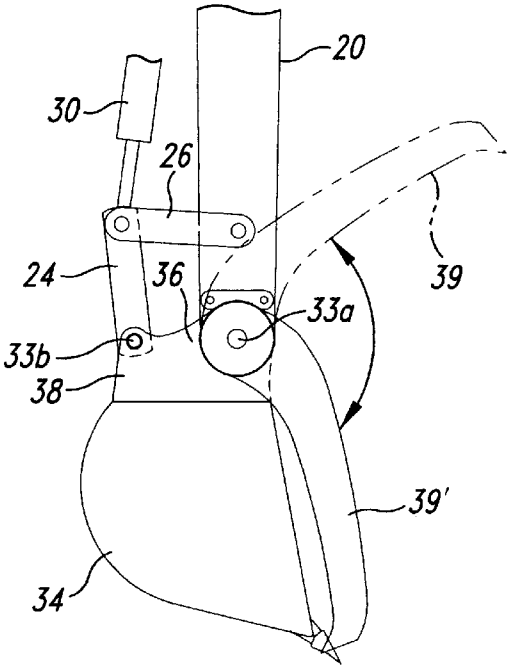
FIG. 10*b* is a right side fragmentary, elevational view of the third alternative embodiment of the tool assembly mounted to the boom arm coaxial with the bucket.
Figure 10A:
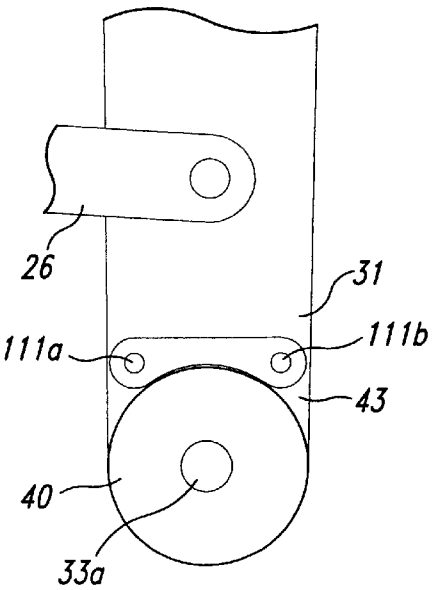
FIG. 10*a* is a left side fragmentary, elevational view of the boom arm modified for use with a third alternative embodiment of the tool assembly of FIG. 1 showing only the rotary actuator thereof.

A third alternative embodiment of the tool assembly 10 is shown in FIGS. 10*a*–10*c* using a bucket lid 39' instead of a bucket extension. In this embodiment the rotary actuator 40 is mounted to the second arm 20 in coaxial arrangement with the bucket 34 and the bucket lid 39' for both rotation of the bucket relative to the second arm and rotation of the bucket lid relative to the bucket about the axis 41 of the rotary actuator. It is noted that with this arrangement the bucket lid 39' is located laterally inward of the sidewalls 34*a* and 34*b* of the bucket 34.

In this third alternative embodiment, the body 42 of the rotary actuator 40 has a pair of attachment flanges 43 by which the actuator body is securely attached to a pair of attachment flanges 21 projecting from the free end portion 31 of the second arm 20. The attachment flanges 43 of the actuator body 42 and the attachment flanges 21 of the second arm 20 each have two transverse apertures therethrough. The one set of apertures of the attachment flanges 21 and 43 are aligned to accept a first pin 111*a* and the other set of apertures of the attachment flanges 21 and 43 are aligned to accept a second pin 111*b* to securely attach the rotary actuator 40 to the second arm 20 for movement therewith and to prevent rotation of the actuator body 42 relative to the second arm. To provide pivotal movement of the bucket 34 relative to the second arm 20 by operation of the hydraulic cylinder 30 using the links 24 and 26, in the manner describe above, the attachment pin 33*a* is rotatably received in an aperture 50*a* extending longitudinally fully through the shaft 50 of the rotary actuator 40. As before, the first clevis 36 of the bucket 34 receives the attachment pin 33*a* for rotation of the bucket thereabout in response to operation of the hydraulic cylinder 30. To facilitate independent rotation of the bucket 34 on the attachment pin 33*a* from rotation of the shaft 50 of the rotary actuator 40, the attachment pin 33*a* is rotatably supported in the shaft aperture 50*a* by bearings 50*b*. To rotate the bucket lid 39' relative to the second arm 20 attached to the actuator body 42, and hence also the bucket 34, the bucket lid is attached to the shaft flange portion 52 and shaft nut 58 of the shaft 50, as described above, and rotates with the shaft in response to the linear reciprocation of the piston sleeve 82. In this embodiment, the relative rotational movement of the bucket lid 39' and the bucket 34 depends upon the operation of both the hydraulic actuator 30 and the rotary actuator 40.

FIGS. 11*a*–11*f* show a fourth alternative embodiment of the tool assembly 10 which allows the bucket 34, bucket extension 39 and rotary actuator 40 to be tilted and rotated relative to the arm rotation plane defined by the first and second arms 14 and 20. The rotary actuator based tiltable feature is fully disclosed in U.S. Pat. No. 5,487,230, Tool Actuator With Adjustable Attachment Mount, which is incorporated herein in its entirety. The first and second devises 36 and 38 are used to removably attach the rotary actuator 40 and bucket 34 to a turntable bearing assembly 113. The turntable bearing assembly 113 is also attached to a rotary actuator assembly 112 having a rotary actuator constructed generally as described above for rotary actuator 40 and arranged transverse to the rotary actuator 40. The rotary actuator assembly 112 has a pair of clevis 112*b* which are attached to the free end portion 31 of the second arm 20 and to the free end portion 32 of the rotation link 24.

The bucket 34, bucket extension 39 and rotary actuator 40 can be selectively rotated or tilted about an axis of rotation 112*a* of the rotary actuator assembly 112 and selectively rotated about an axis of rotation 113*a* of the turntable bearing assembly 113. The turntable bearing assembly 113 includes a turntable bearing with a first member 113*b* thereof to which the tool assembly 10 is attached using the first and second clevises 36 and 38 for rotation therewith. The first turntable member 113*b* has a ring gear with internal teeth. A second turntable member 113*c* rotatably supports the first turntable member 113*b* therebelow and supports a hydraulic motor and brake unit 113*d* with a bull gear drivingly engaging the ring gear to selectively rotate the first turntable member 113*b* relative to the second turntable member 113*c* when the hydraulic motor 113*d* is powered. This provides 360° of continuous rotation.

The axis of rotation 112*a* of the rotary actuator assembly 112 is transverse to the axis of rotation 41 of the rotary actuator 40, and the axis of rotation 113*a* of the turntable bearing assembly 113 is transverse to the axis of rotation 41 of the rotary actuator 40. Further, the axis of rotation 112*a* of the rotary actuator assembly 112 is transverse to the axis of rotation 113*a* of the turntable bearing assembly 113, to provide an orthogonal arrangement of axes of rotation 41, 112*a* and 113*a*, and provide a degree of movement of the bucket 34 and bucket extension that significantly increases the efficiency and effectiveness of operation. The bucket 34, bucket extension 39 and rotary actuator 40 are shown in the side view of FIG. 11*b* rotated as a unit by 90° about the turntable bearing axis of rotation 113*a* from the position shown in the side view of FIG. 11*a* by operation of the turntable bearing assembly 113. In the side view of FIG. 11*c* the rotation is 180° from the position in FIG. 11*a*. In the front view of FIG. 11*d*, the bucket 34, bucket extension 39 and rotary actuator 40 are shown in the same rotational position as shown in FIG. 11*a*, but tilted laterally relative to the arm rotation plane by rotation about the rotational axis 112*a* of the rotary actuator assembly 112 by operation of the rotary actuator assembly 112.

Figure 11B:
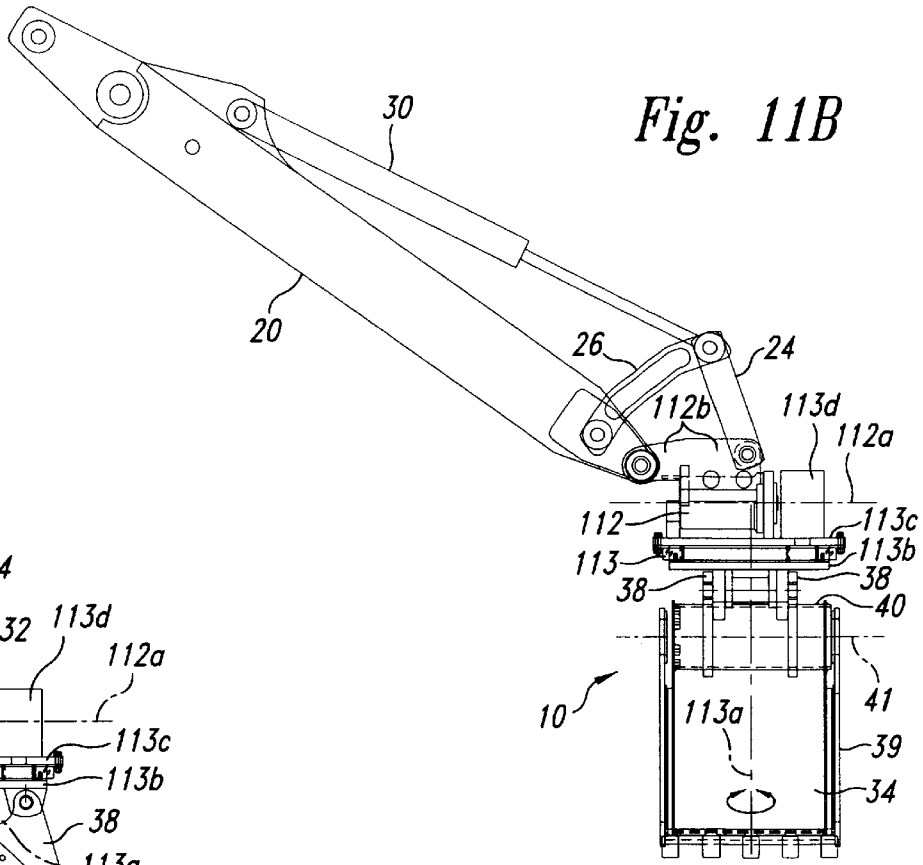
FIG. 11*b* is a left side elevational view of the fourth alternative embodiment of the tool assembly of FIG. 11*a* with the bucket rotated 90°.
Figure 11A:
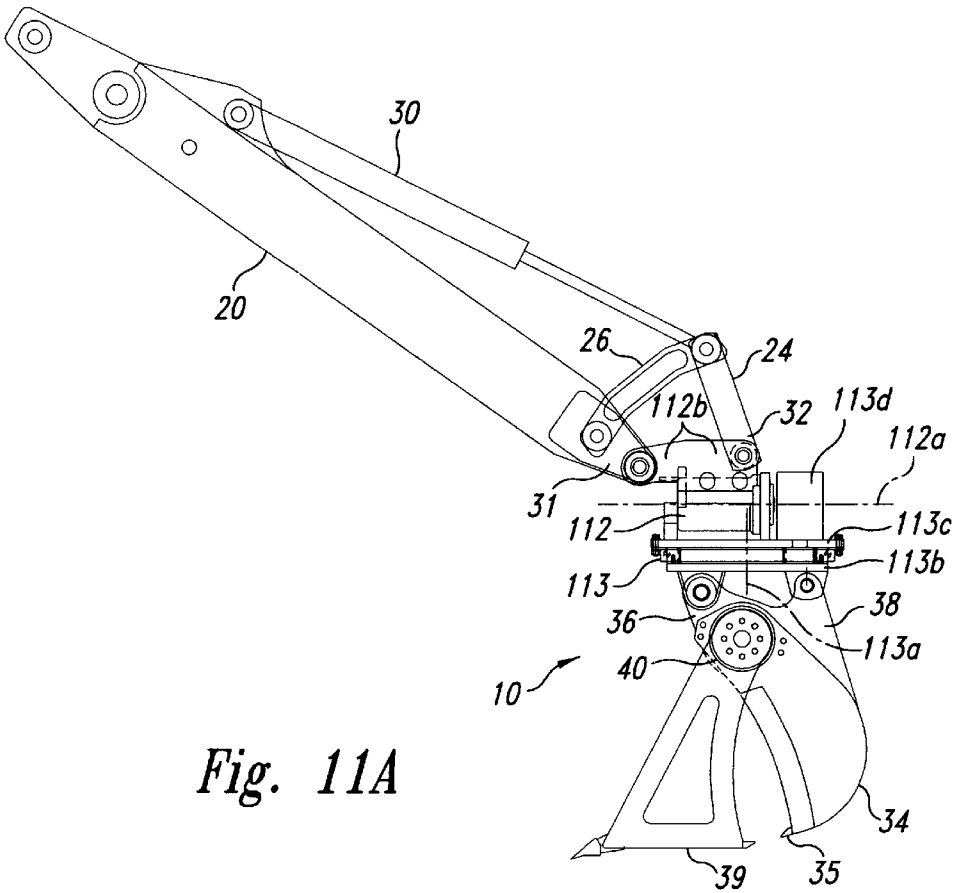
FIG. 11*a* is a left side elevational view of the boom arm and a fourth alternative embodiment of the tool assembly of FIG. 1 also providing lateral tilting and rotation of the tool assembly relative to the plane swept out by the boom arm.
Figure 11D:
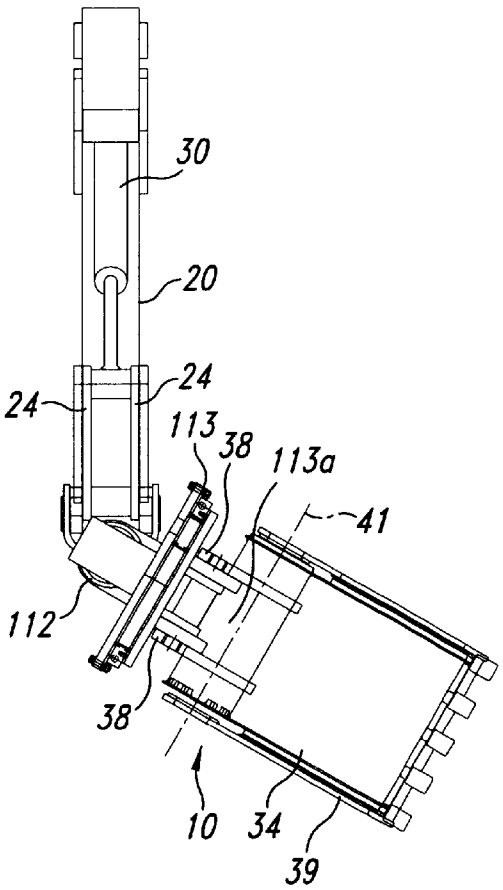
FIG. 11*d* is a front elevational view of the fourth alternative embodiment of the tool assembly of FIG. 11*a* with the bucket laterally tilted.
Figure 11C:
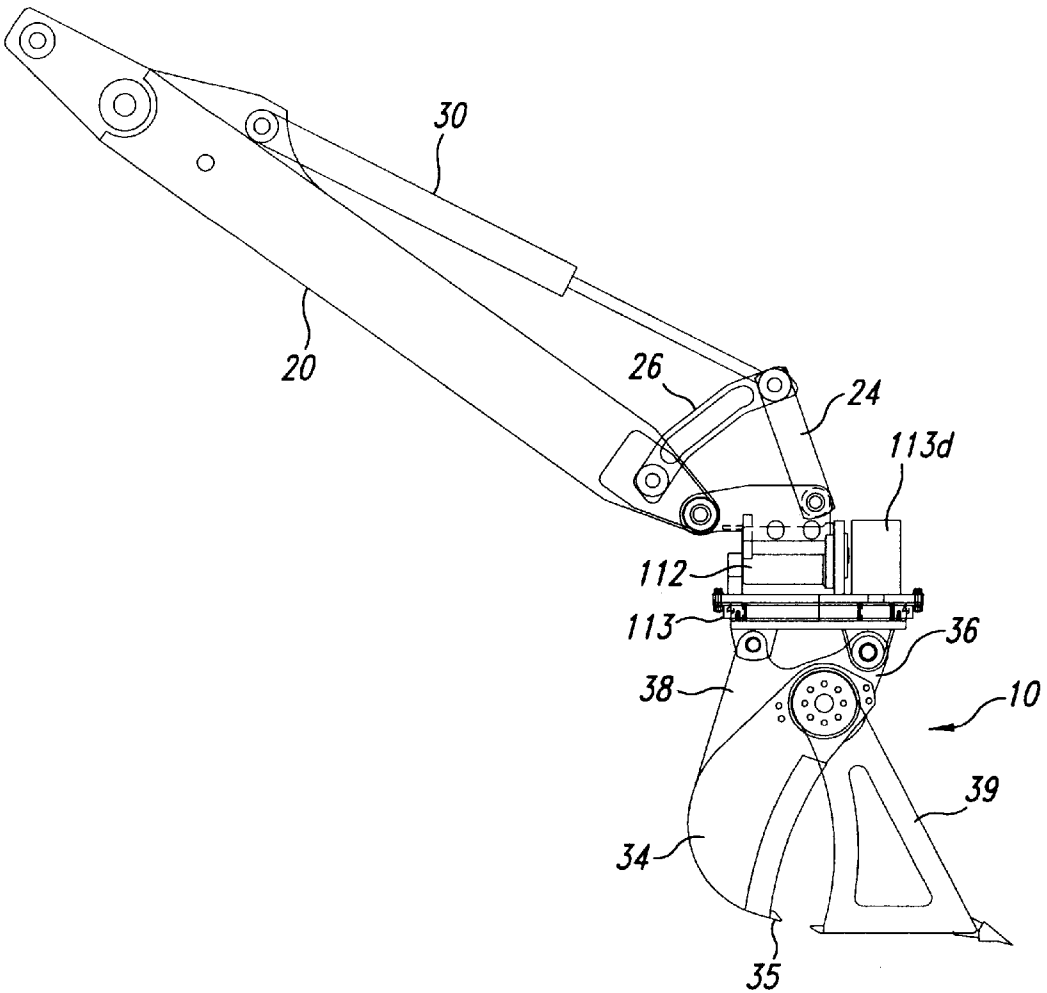
FIG. 11*c* is a left side elevational view of the fourth alternative embodiment of the tool assembly of FIG. 11*a* with the bucket rotated 180°.
Figure 11F:
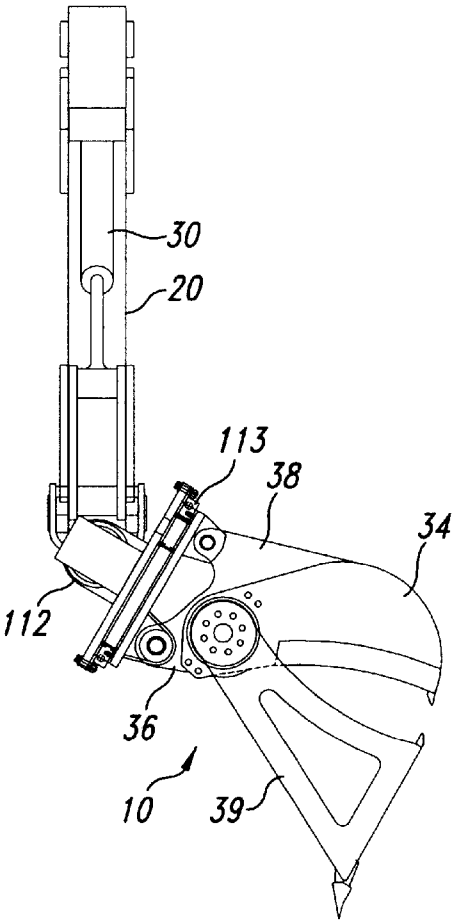
FIG. 11*f* is a front elevational view of the fourth alternative embodiment of the tool assembly of FIG. 11*a* in the rotational position of FIG. 11*b* and with the bucket laterally tilted.
Figure 11E:
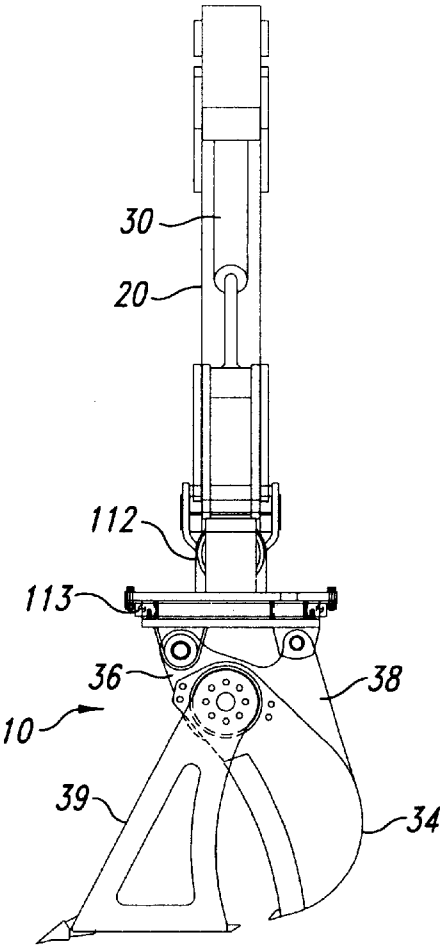
FIG. 11*e* is a front elevational view of the fourth alternative embodiment of the tool assembly of FIG. 11*a* in the rotational position of FIG. 11*b*.

In the front views of FIGS. 11*e* and 11*f*, the bucket 34, bucket extension 39 and rotary actuator 40 are shown in the same rotational position as shown in FIG. 11*b*, but in FIG. 11*f* they are tilted laterally relative to the arm rotation plane by rotation about the rotational axis 112*a* of the rotary actuator assembly 112 by operation of the rotary actuator assembly 112.

Figure 12B:
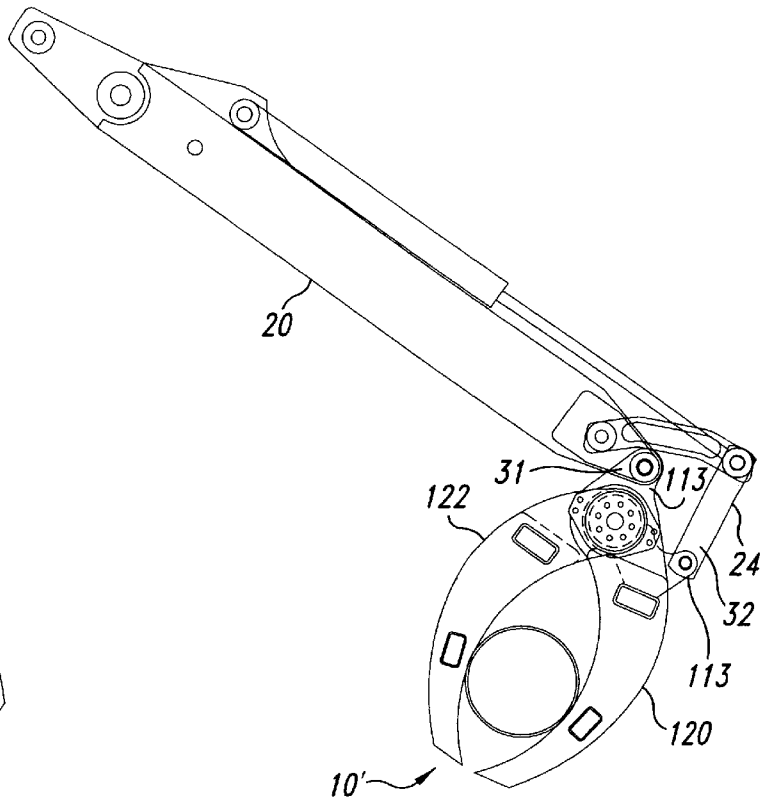
FIGS. 12*a* and 12*b* are left side elevational views of the boom arm and an alternative tool assembly embodying the present invention having first and second grapple members, with the first grapple member shown in various rotational positions relative to the boom arm and the second grapple member shown in various rotational positions relative to the first grapple member.
Figure 12A:
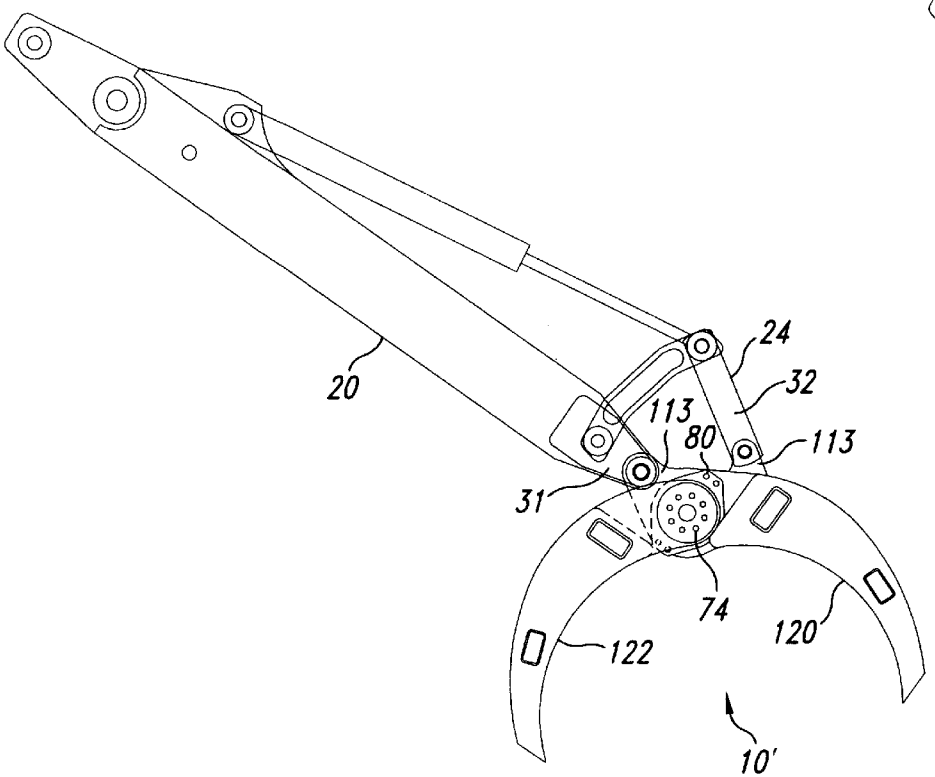

FIGS. 12*a* and 12*b* show an alternative tool assembly 10' which comprises a brush rake or grapple having a first grapple member 120, and an opposing second grapple member 122. The first grapple member 120 is attached to the actuator body 42 by the attachment bolts 80 and the second grapple member 122 is attached to the shaft flange portion 52 by the attachment bolts 74, much as described above for the embodiment of FIGS. 1–3. FIG. 12*a* shows the tool assembly 10' in a fully open position and FIG. 12*b* shows the tool assembly in a closed position grasping a pipe. As viewed in FIGS. 12*a* and 12*b*, the rotary actuator 40 rotates the second grapple member 122 in a counterclockwise direction relative to the first grapple member 120 when moving from an open position (FIG. 12*a*) to a closed position (FIG. 12*b*).

Figure 14:
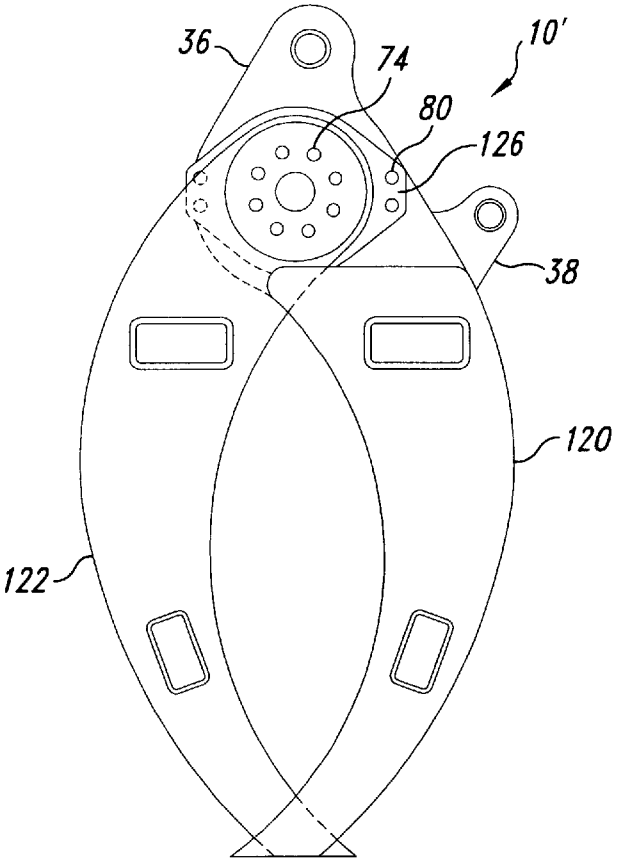
FIG. 14 is a left side elevational view of the alternative tool assembly of FIGS. 12*a* and 12*b* shown removed from the boom area.
Figure 13:
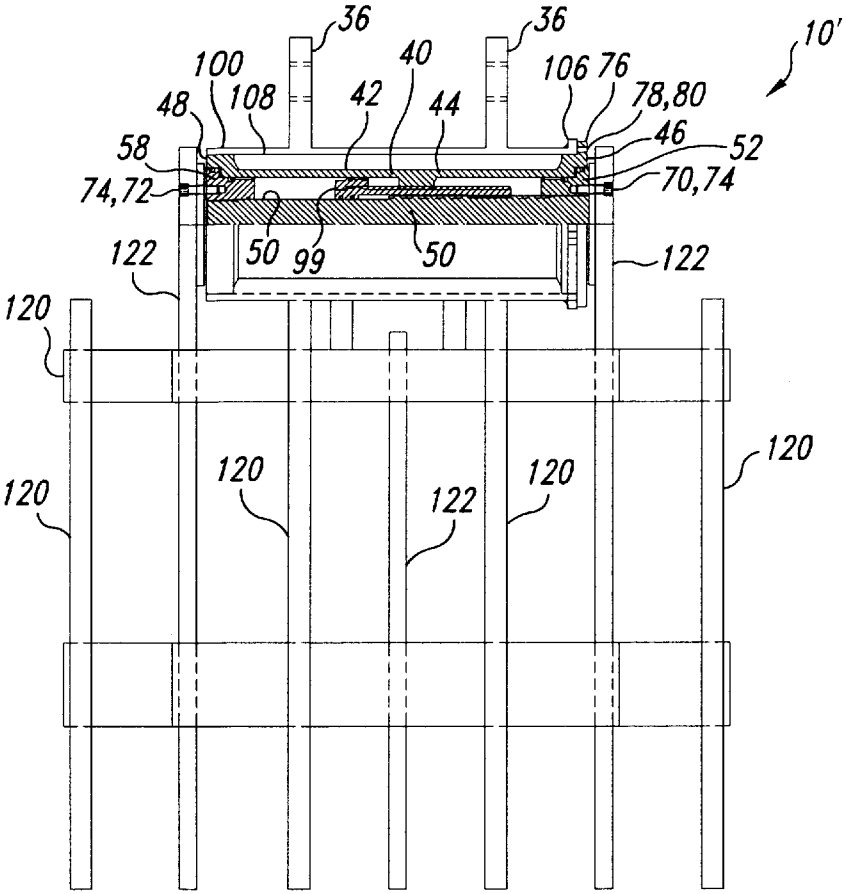
FIG. 13 is an enlarged, front elevational, sectional view of the alternative tool assembly of FIGS. 12*a* and 12*b* shown removed from the boom arm.

FIGS. 13 and 14 illustrate the tool assembly 10' of FIGS. 12*a* and 12*b* as having a similar construction to the tool assembly 10 of FIG. 7 with the rotary actuator 40 slidably received into the support tube 105 and with the several fingers comprising the first grapple member 120 fixedly attached to the support tube. Two of the fingers comprising the second grapple member 122 are attached to the shaft flange portion 52 and shaft nut 58 of the rotary actuator 40 by the attachment bolts 74 for rotation with the shaft 50.

Figures 15A, 15B, 15C, 15D:
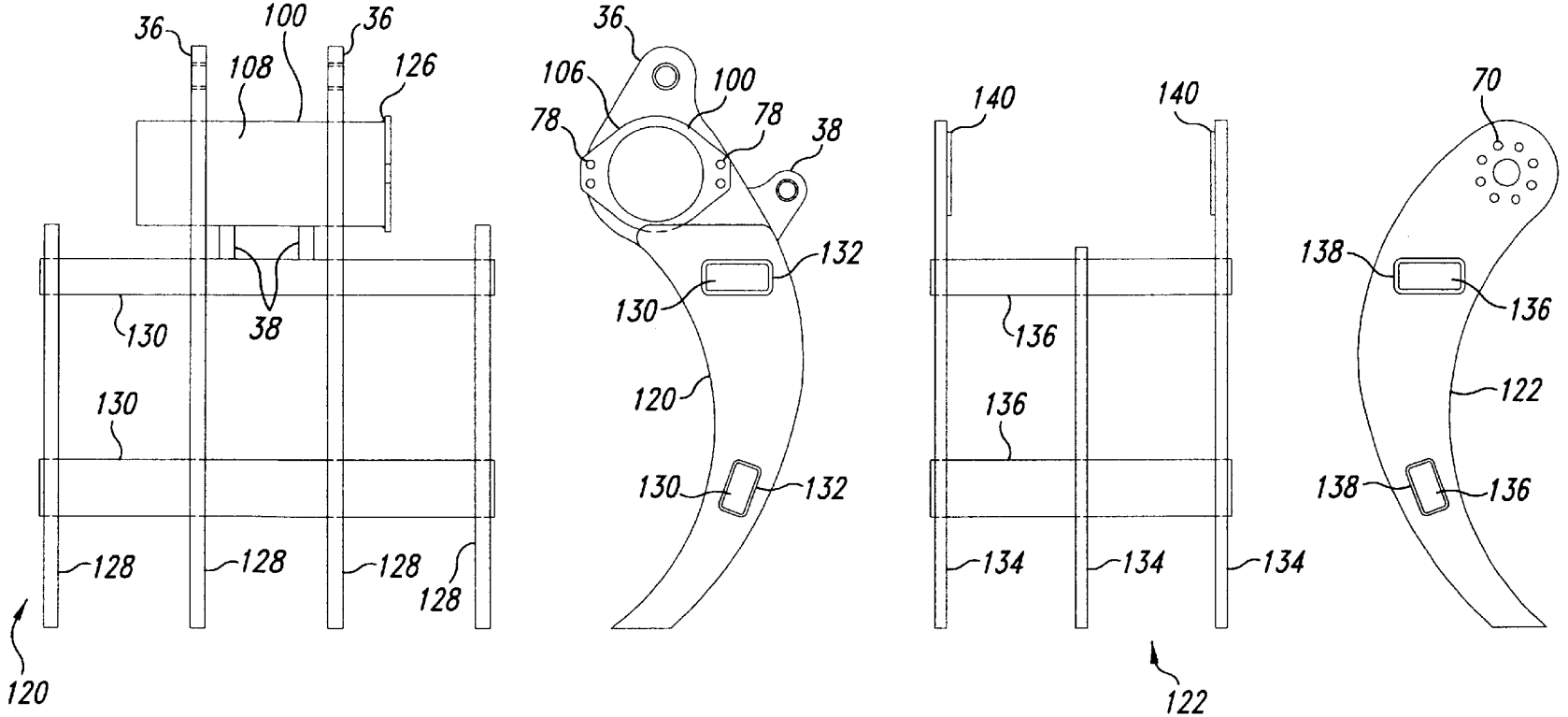
FIG. 15*a* is a front elevational view of the first grapple member of the alternative tool assembly of FIGS. 12*a* and 12*b*.
FIG. 15*b* is a left side elevational view of the first grapple member of FIG. 15*a*.
FIG. 15*c* is a front elevational view of the second grapple member of the alternative tool assembly of FIGS. 12*a* and 12*b*.
FIG. 15*d* is a left side elevational view of the second grapple member of FIG. 15*c*.

FIGS. 15*a* and 15*b* illustrate the first grappling member 120 as having four grappling prongs or fingers 128 and cross members 130 extending through transverse apertures 132 in the grappling fingers and fixedly attached thereto. FIGS. 15*c* and 15*d* illustrate the second grappling member 122 as having grappling prongs or fingers 134 and cross members 136 extending through transverse apertures 138 in the grappling fingers and fixedly attached thereto. Two of the fingers 134 each have at one end a flange 140 and are spaced about to receive the rotary actuator 40 therebetween. The flanges 140 are attached to the flange portion 52 and the shaft nut 58 of the shaft 50 by the attachment bolts 74.

Figure 16A:
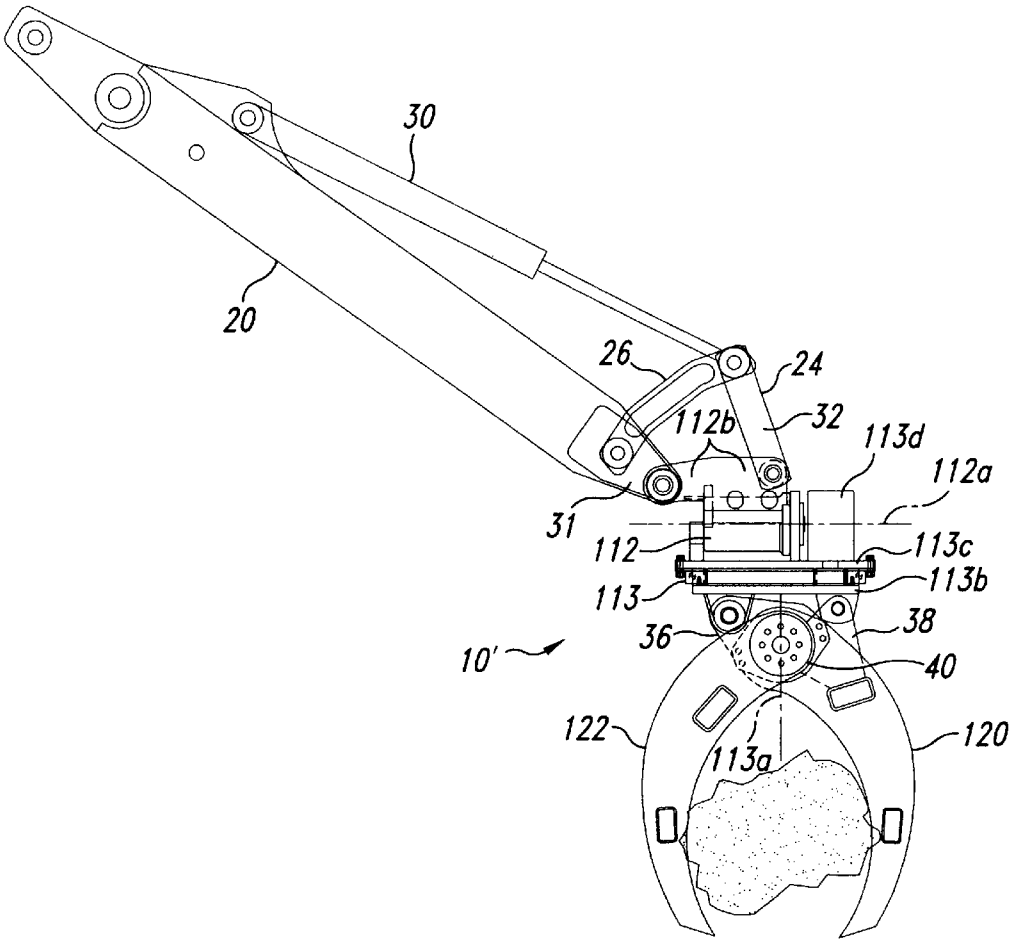
FIG. 16*a* is a left side elevational view of the boom arm and a first alternative embodiment of the alternative tool assembly of FIGS. 12*a* and 12*b* providing lateral tilting and rotation of the alternative tool assembly relative to the plane swept out by the boom arm.
Figure 16C:
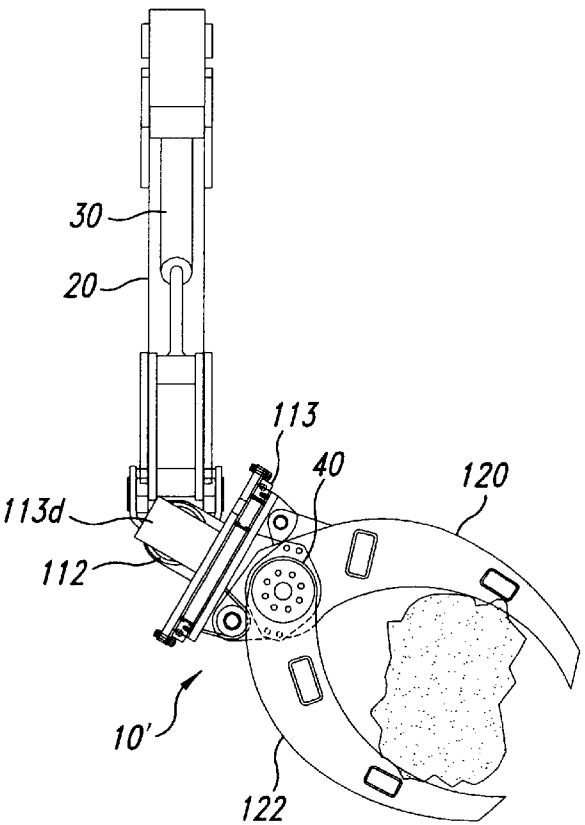
FIG. 16*c* is a front elevational view of the first alternative embodiment of the alternative tool assembly of FIG. 16*a* in the rotational position of FIG. 16*b* and with the alternative tool assembly laterally tilted.
Figure 16B:
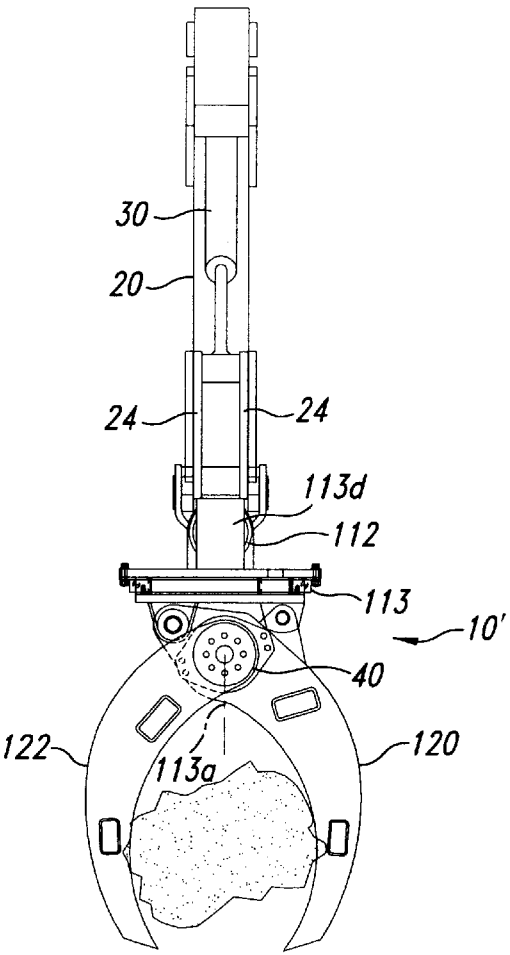
FIG. 16*b* is a front elevational view of the first alternative embodiment of the alternative tool assembly of FIG. 16*a* with the tool assembly rotated 90°.

FIGS. 16*a*–16*c* show a first alternative of the tool assembly 10' of FIGS. 12*a* and 12*b* which allow the first and second grapple members 120 and 122, and the rotary actuator 40 to be tilted and rotated relative to the arm rotation plane defined by the first and second arms 14 and 20, much as in the embodiments of the tool assembly 10 shown in FIGS. 11*a*–11*f*. As described above, the rotary actuator assembly 112 has a rotary actuator constructed generally as described above for rotary actuator 40 and is arranged transverse to the rotary actuator 40. The first and second grapple members 120 and 122 and the rotary actuator 40 can be selectively rotated or tilted about the axis of rotation 112*a* of the rotary assembly 112 and selectively rotated about the axis of rotation 113*a* of the turntable bearing assembly 113, as described above for the fourth alternative embodiment of the tool assembly 10 of FIGS. 11*a*–11*f*. As described above, the rotary actuator 40, the rotary actuator assembly 112 and the turntable bearing assembly 113 have an orthogonal arrangement of axes of rotation 41, 112*a*, and 113*a* to provide a high degree of movement for the first and second grapple members 120 and 122 as a unit.

Figure 17:
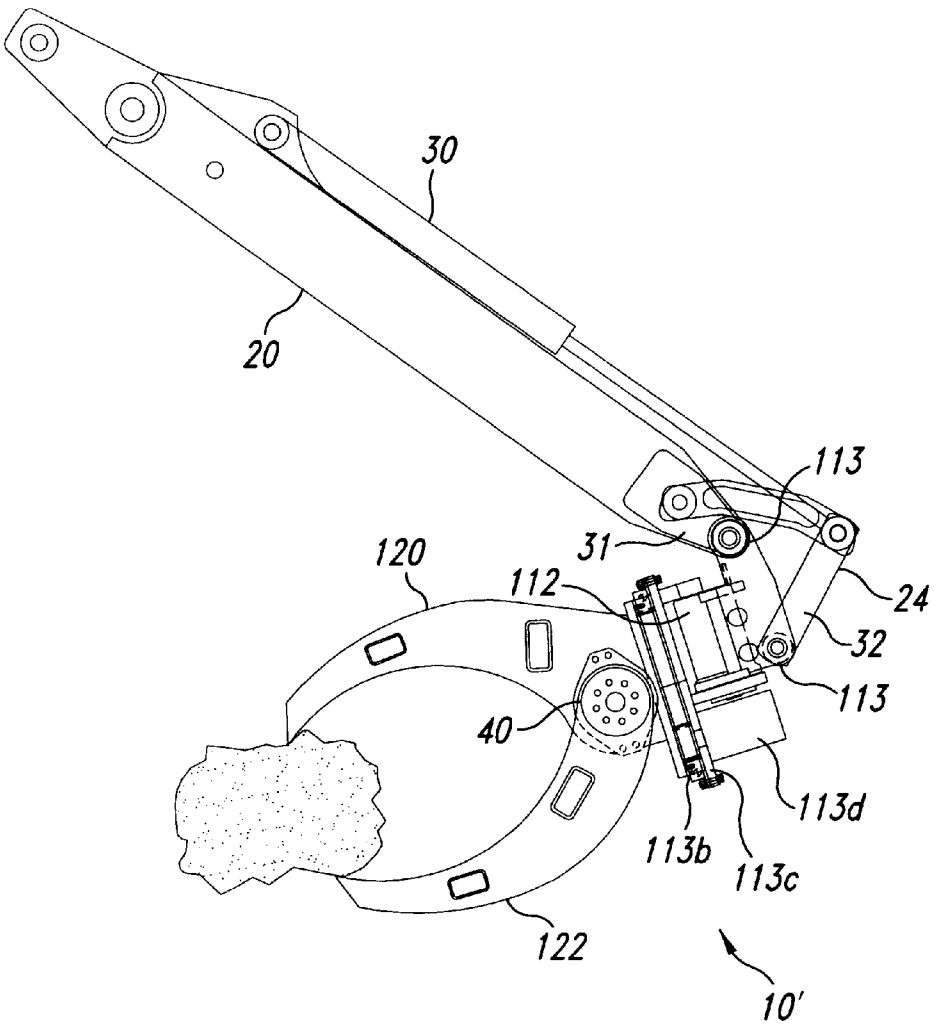
FIG. 17 is a left side elevational view of the boom arm and a second alternative embodiment of the alternative tool assembly of FIGS. 12*a* and 12*b* also providing lateral tilting and rotation to the alternative tool assembly relative to the plane swept out by the boom arm.

FIG. 17 shows a second alternative of the tool assembly 10' of FIGS. 12*a* and 12*b* of a similar construction as shown in FIGS. 16*a*–16*c* but with the first grapple member 120 and the rotary actuator 40 fixedly attached to the first turntable member 113*b* whereas FIGS. 16*a*–16*c* depict attachment using the devises 36 and 38.

It will be appreciated that, although specific embodiments of the invention have been described herein for purposes of illustration, various modifications may be made without departing from the spirit and scope of the invention. Accordingly, the invention is not limited except as by the appended claims.

We claim:

1. A fluid-powered tool assembly, usable with a support platform having an arm, the tool assembly comprising:

a first tool member pivotally connectable to the arm for rotation about a first axis;

a second tool member positioned to cooperate with said first tool member;

a body having a longitudinal axis and an end portion, said end portion having one of said first and second tool members attached thereto for movement with said body, one of said first and second tool members further including a support housing sized to receive at least a portion of said body therein and support said body, said support housing being a support tube;

an output shaft rotatably disposed within said body in general alignment with said body axis for rotation about a second axis spaced apart from said first axis, said shaft having a shaft end portion, with the other of said first and second tool members attached thereto for movement with said shaft; and a linear-to-rotary force transmitting member mounted for longitudinal movement within said body in response to selective application of pressurized fluid thereto, said force transmitting member engaging said body and said shaft to translate longitudinal movement of said force transmitting member into rotational movement of said shaft relative to said body, said first and second tool members being rotatable relative to each other about said second axis by operation of said force transmitting member and said first tool member pivotal connection to the arm allowing rotation of the tool assembly as a unit about said first axis, said force transmitting member being operable to rotate said first and second tool members about said second axis independent of rotation of said first tool member about said first axis.

2. The tool assembly of claim 1 wherein said first tool member comprises a bucket and the second tool member comprises a bucket accessory which cooperates with said bucket.

3. The tool assembly of claim 1 wherein said first tool member comprises a first grapple member having one or more prongs and the second tool member comprises a second grapple member having one or more prongs, wherein said first grapple member is positionable to cooperate with said second grapple member.

4. The tool assembly of claim 1 wherein said body has first and second end portions, and wherein said first body end portion is attached to said support housing and said second body end portion is engaged by said support housing and held thereby against transverse movement.

5. The tool assembly of claim 1 wherein said first tool member includes said support housing and said support housing is pivotally connectable to the arm for rotation about said first axis.

6. The tool assembly of claim 1, further including a lateral tilt assembly and wherein said first tool member is pivotally connected to the arm through said lateral tilt assembly, said lateral tilt assembly having an actuator operable independent of said force transmitting member to laterally tilt said first tool member relative to the arm about a tilt axis out of alignment with said first axis, and an attachment member pivotally connectable to the aim for rotation of said lateral tilt assembly and said first tool member together about said first axis.

7. The tool assembly of claim 6, further including a rotation assembly positioned between said first tool member and said lateral tilt assembly, and operable independent of said force transmitting member and said tilt actuator to rotate said first tool member relative to the arm.

8. The tool assembly of claim 7 wherein said lateral tilt assembly is arranged with said tilt axis transverse to said first axis, and said rotation assembly is arranged to rotate said first tool member about a rotation axis transverse to said first axis.

9. The tool assembly of claim 8 wherein said rotation assembly is arranged with said rotation axis transverse to said tilt axis.

10. The tool assembly of claim 7 wherein said rotation assembly includes a turntable bearing.

11. The tool assembly of claim 1, further including a rotation assembly and wherein said first tool member is pivotally connected to the arm through said rotation assembly, said rotation assembly being operable independent of said force transmitting member to rotate said first tool member relative to the arm about a rotation axis out of alignment with said first axis, said rotation assembly having an attachment member pivotally connectable to the arm to rotate said rotation assembly and said first tool member together about said first axis.

12. The tool assembly of claim 11 wherein said rotation assembly is arranged with said rotation axis transverse to said first axis.

13. The tool assembly of claim 11 wherein said rotation assembly includes a turntable bearing.

14. The tool assembly of claim 1 wherein said shaft has first and second opposite shafts end portions with the other of said first and second tool members attached to both said first and second shaft end portions for movement with said shaft.

15. A fluid-powered tool assembly, usable with a support platform having an arm, the tool assembly comprising:

an arm connection member pivotally connectable to the arm for rotation about a first axis;

a first tool member;

a second tool member positioned to cooperate with said first tool member;

a body having a longitudinal axis and one of said first and second tool members attached thereto for movement with said body, said body further having first and second end portions;

a shaft rotatably disposed within said body in general alignment with said body axis for rotation about a second axis spaced apart from said first axis, said shaft having the other of said first and second tool members attached thereto for rotational movement with said shaft;

a linear-to-rotary force transmitting member mounted for longitudinal movement within said body in response to selective application of pressurized fluid thereto, said force transmitting member engaging said body and said shaft to translate longitudinal movement of said force transmitting member into rotational movement of said shaft relative to said body, said first and second tool members being rotatable relative to each other about said second axis by operation of said force transmitting member, said pivotal connection of said arm connection member to the arm allowing rotation of the tool assembly as a unit about said first axis, said force transmitting member being operable to rotate said first and second tool members about said second axis independent of rotation of said arm connection member about said first axis; and a support housing sized to receive at least a portion of said body therein and support said body, said first body end portion being attached to said support housing and said second body end portion being engaged by said support housing to restrict transverse movement of said second body end portion.

16. The tool assembly of claim 15 wherein said one of said first or second tool member attached to said body is indirectly attached to said body through said support housing.

17. The tool assembly of claim 15, further including a lateral tilt assembly having an actuator operable independent of said force transmitting member to laterally tilt said first and second tool members as a unit relative to the arm about a tilt axis out of alignment with said first axis, said arm connection member being attached to said lateral tilt assembly.

18. The tool assembly of claim 17, further including a rotation assembly positioned between said first and second tool members and said lateral tilt assembly and operable independent of said force transmitting member and said tilt actuator to rotate said first and second tool members as a unit relative to the arm about a rotation axis out of alignment with both said first axis and said tilt axis.

19. The tool assembly of claim 16 wherein said lateral tilt assembly is arranged with said tilt axis transverse to said first axis, and said rotation assembly is arranged with said rotation axis transverse to said first axis.

20. The tool assembly of claim 19 wherein said rotation assembly is arranged with said rotation axis transverse to said tilt axis.

21. The tool assembly of claim 18 wherein said rotation assembly includes a turntable bearing.

22. The tool assembly of claim 15, further including a rotation assembly positioned between said arm connection member and said first and second tool members, said rotation assembly being operable independent of said force transmitting member to rotate said first and second tool members as a unit relative to the arm about a rotation axis out of alignment with said first axis, said rotation assembly and said first and second tool members being rotatable as a unit about said first axis.

23. The tool assembly of claim 22 wherein said rotation assembly includes a turntable bearing.

24. The tool assembly of claim 15 wherein said shaft has first and second opposite shafts end portions with the other of said first and second tool members attached to both said first and second shaft end portions for movement with said shaft.

25. A fluid-powered tool assembly, usable with a support platform having an arm, the tool assembly comprising:

a support housing;

a first tool member, at least one of said support housing and said first tool member being pivotally connectable to the arm for rotation about a first axis;

a second tool member positioned to cooperate with said first tool member;

a body having a longitudinal axis and being removably positioned in said support housing, one of said body and said support housing having one of said first and second tool members attached thereto for movement therewith, said support housing being sized to snugly receive at least a portion of said body therein and support said body, said body further having first and second end portions, said first body end portion being attached to said support housing and said second body end portion being engaged by said support housing and held thereby against transverse movement;

a shaft rotatably disposed within said body in general alignment with said body axis for rotation about a second axis spaced apart from said first axis, said shaft having the other of said first and second tool members attached thereto for movement with said shaft; and a linear-to-rotary force transmitting member mounted for longitudinal movement within said body in response to selective application of pressurized fluid thereto, said force transmitting member engaging said body and said shaft to translate longitudinal movement of said force transmitting member into rotational movement of said shaft relative to said body, said first and second tool members being rotatable relative to each other about said second axis by operation of said force transmitting member and said one of said support housing or first tool member pivotal connection to the arm allowing rotation of the tool assembly as a unit about said first axis.

26. The tool assembly of claim 25, further including a lateral tilt assembly and wherein said one of said support housing or first tool member pivotally connectable to the arm is connected thereto through said lateral tilt assembly, said lateral tilt assembly having an actuator operable independent of said force transmitting member to laterally tilt said one of said support housing or first tool member relative to the arm about a tilt axis out of alignment with said first axis and an attachment member pivotally connectable to the arm for rotation of said lateral tilt assembly and said first and second tool members together about said first axis.

27. The tool assembly of claim 26, further including a rotation assembly positioned between said first and second tool members and said lateral tilt assembly and operable independent of said force transmitting member and said tilt actuator to rotate said first and second tool members as a unit relative to the arm about a rotation axis out of alignment with both said first axis and said tilt axis.

28. The tool assembly of claim 27 wherein said rotation assembly is arranged with said rotation axis transverse to said tilt axis.

29. The tool assembly of claim 27 wherein said rotation assembly includes a turntable bearing.

30. The tool assembly of claim 25, further including a rotation assembly operable independent of said force transmitting member to rotate said first and second tool members as a unit relative to the arm about a rotation axis out of alignment with said first axis, said rotation assembly and said first and second tool members being rotatable as a unit about said first axis.

31. The tool assembly of claim 30 wherein said rotation assembly includes a turntable bearing.

32. The tool assembly of claim 25 wherein said shaft has first and second opposite shafts end portions with the other of said first and second tool members attached to both said first and second shaft end portions for movement with said shaft.

33. A fluid-powered tool assembly, usable with a support platform having an arm, the tool assembly comprising:

a connection member pivotally connectable to the arm for rotation of the tool assembly about a pivot axis;

a first tool member;

a second tool member positioned to cooperate with said first tool member;

a body having a longitudinal axis and one of said first and second tool members attached thereto for movement with said body;

a shaft rotatably disposed within said body in general alignment with said body axis for rotation about a shaft axis, said shaft having the other of said first and second tool members attached thereto for movement with said shaft;

a linear-to-rotary force transmitting member mounted for longitudinal movement within said body in response to selective application of pressurized fluid thereto, said force transmitting member engaging said body and said shaft to translate longitudinal movement of said force transmitting member into rotational movement of said shaft relative to said body, said first and second tool members being rotatable relative to each other about said shaft axis by operation of said force transmitting member; and a support housing sized to receive at least a portion of said body therein and support said body, said support housing being a support tube.

34. The tool assembly of claim 33 wherein said connection member is attached to said support housing.

35. The tool assembly of claim 33 wherein said connection member is attached to one of said first and second tool members.

36. The tool assembly of claim 33 wherein said connection member is attached to said body.

37. The tool assembly of claim 33 further including a lateral tilt assembly having an actuator operable to laterally tilt said first and second tool members relative to the arm about a tilt axis out of alignment with said pivot axis, said connection member being attached to said lateral tilt assembly.

38. The tool assembly of claim 37, further including a rotation assembly positioned between said first and second tool members and said lateral tilt assembly, and operable to rotate said first and second tool members relative to the arm about a rotation axis out of alignment with both said pivot axis and said tilt axis.

39. The tool assembly of claim 38 wherein said lateral tilt assembly is arranged with said tilt axis transverse to said pivot axis, and said rotation assembly is arranged with said rotation axis transverse to said pivot axis.

40. The tool assembly of claim 39 wherein said rotation assembly is arranged with said rotation axis transverse to said tilt axis.

41. The tool assembly of claim 38 wherein said rotation assembly includes a turntable bearing.

42. The tool assembly of claim 33, further including a rotation assembly positioned between said connection member and said first and second tool members, said rotation assembly being operable to rotate said first and second tool members relative to the arm about a rotation axis out of alignment with said pivot axis, said rotation assembly being adapted to be connected to the arm by said connection member to rotate said rotation assembly and said first and second tool members together about said pivot axis.

43. The tool assembly of claim 42 wherein said rotation assembly is arranged with said rotation axis transverse to said pivot axis.

44. The tool assembly of claim 42 wherein said rotation assembly includes a turntable bearing.

45. The tool assembly of claim 33 wherein said shaft has first and second opposite shafts end portions with the other of said first and second tool members attached to both said first and second shaft end portions for movement with said shaft.

46. A support platform comprising:

a support platform structure;

an arm connected to said structure; and a tool assembly pivotally attached to said arm, said tool assembly including:

an arm connection member pivotally connectable to said arm for rotation about a first axis;

a first tool member;

a second tool member positioned to cooperate with said first tool member;

a body having a longitudinal axis and one of said first and second tool members attached thereto for movement with said body, one of said first and second tool members further including a support housing sized to receive at least a portion of said body therein and support said body, said support housing being a support tube;

a shaft rotatably disposed within said body in general alignment with said body axis for rotation about a second axis spaced apart from said first axis, said shaft having the other of said first and second tool members attached thereto for movement with said shaft; and a linear-to-rotary force transmitting member mounted for longitudinal movement within said body in response to selective application of pressurized fluid thereto, said force transmitting member engaging said body and said shaft to translate longitudinal movement of said force transmitting member into rotational movement of said shaft relative to said body, said first and second tool members being rotatable relative to each other about said second axis by operation of said force transmitting member, said pivotal connection of said arm connection member to said arm allowing rotation of the tool assembly as a unit about said first axis.

47. The support platform of claim 46 wherein said arm connection member is attached to said first tool member for rotation of said first tool member therewith about said first axis, and the support platform further includes a tool actuator connected between said arm and said first tool member for selected rotation of said first tool member about said first axis relative to said arm independent of operation of said force transmitting member.

48. The support platform of claim 46, further including a lateral tilt assembly having an actuator operable to laterally tilt said first and second tool members relative to said arm about a tilt axis out of alignment with said first axis, said arm connection member being attached to said lateral tilt assembly.

49. The support platform of claim 48, further including a rotation assembly positioned between said first and second tool members and said lateral tilt assembly, and operable to rotate said first and second tool members relative to said arm about a rotation axis out of alignment with both said first axis and said tilt axis.

50. The support platform of claim 49 wherein said lateral tilt assembly is arranged with said tilt axis transverse to said first axis, and said rotation assembly is arranged with said rotation axis transverse to both said first axis and said tilt axis.

51. The support platform of claim 49 wherein said rotation assembly includes a turntable bearing.

52. The support platform of claim 46, further including a rotation assembly supporting said first and second tool members, said rotation assembly being operable to rotate said first and second tool members relative to said arm about a rotation axis out of alignment with said first axis, said rotation assembly being connected to said arm by said arm connection member to rotate said rotation assembly and said first and second tool members together about said first axis.

53. A fluid-powered tool assembly, usable with a support platform having an arm, the tool assembly comprising:

a connection member pivotally connectable to the arm for rotation of the tool assembly about a pivot axis;

a first tool member;

a second tool member positioned to cooperate with said first tool member;

a body having a longitudinal axis and one of said first and second tool members attached thereto for movement with said body, said body further having first and second end portions;

a shaft rotatably disposed within said body in general alignment with said body axis for rotation about a shaft axis, said shaft having the other of said first and second tool members attached thereto for movement with said shaft;

a linear-to-rotary force transmitting member mounted for longitudinal movement within said body in response to selective application of pressurized fluid thereto, said force transmitting member engaging said body and said shaft to translate longitudinal movement of said force transmitting member into rotational movement of said shaft relative to said body, said first and second tool members being rotatable relative to each other about said shaft axis by operation of said force transmitting member; and a support housing sized to receive at least a portion of said body therein and support said body, said first body end portion being attached to said support housing and said second body end portion being engaged by said support housing to restrict transverse movement of said second body end portion.

54. The tool assembly of claim 40 wherein said one of said first or second tool member attached to said body is indirectly attached to said body through said support housing.

55. A fluid-powered tool assembly, usable with a support platform having an arm, the tool assembly comprising:

a first tool member;

a second tool member positioned to cooperate with said first tool member;

a body having a longitudinal axis, said body being connectable to the arm for movement therewith, one of said first and second tool members further including a support housing sized to receive at least a portion of said body therein and support said body, said support housing being a support tube;

a shaft rotatably disposed within said body in general alignment with said body axis for rotation about a shaft axis, said shaft having said second tool member attached thereto for rotational movement with said shaft about said shaft axis and said first tool member being rotatably mounted in general alignment with said shaft axis for rotation independent of rotation of said shaft relative to said body; and a linear-to-rotary force transmitting member mounted for longitudinal movement within said body in response to selective application of pressurized fluid thereto, said force transmitting member engaging said body and said shaft to translate longitudinal movement of said force transmitting member into rotational movement of said shaft relative to said body, said second tool member being rotated relative to said first tool member about said shaft axis by operation of said force transmitting member.

56. The tool assembly of claim 55 wherein said shaft has an axially extending opening therethrough and a pivot pin disposed in said shaft opening, said first tool member being rotatably mounted on said pivot pin for rotation independent of rotation of said shaft relative to said body.

57. A fluid-powered tool assembly, usable with a support platform having an arm, the tool assembly comprising:

a support housing;

a first tool member, at least one of said support housing and said first tool member being pivotally connectable to the arm for rotation about a first axis;

a second tool member positioned to cooperate with said first tool member;

a body having a longitudinal axis and being removably positioned in said support housing, one of said body and said support housing having one of said first and second tool members attached thereto for movement therewith, said support housing being sized to snugly receive at least a portion of said body therein and support said body, said support housing being a support tube receiving said body lengthwise therein in general coaxial alignment therewith;

a shaft rotatably disposed within said body in general alignment with said body axis for rotation about a second axis spaced apart from said first axis, said shaft having the other of said first and second tool members attached thereto for movement with said shaft; and a linear-to-rotary force transmitting member mounted for longitudinal movement within said body in response to selective application of pressurized fluid thereto, said force transmitting member engaging said body and said shaft to translate longitudinal movement of said force transmitting member into rotational movement of said shaft relative to said body, said first and second tool members being rotatable relative to each other about said second axis by operation of said force transmitting member and said one of said support housing or first tool member pivotal connection to the arm allowing rotation of the tool assembly as a unit about said first axis.

* * * * *